US005994047A

United States Patent [19]

Mizukawa et al.

[11] Patent Number: 5,994,047

[45] Date of Patent: Nov. 30, 1999

[54] SILVER HALIDE COLOR PHOTOSENSITIVE MATERIAL AND METHOD FOR PRODUCING COLOR FILTER USING THE SAME

[75] Inventors: Yuki Mizukawa; Tatsuya Igarashi; Hiroyuki Hirai, all of Minami-Ashigara, Japan

[73] Assignee: Fuji Photo Film Co., Ltd., Minami-Ashigara, Japan

[21] Appl. No.: 08/745,856

[22] Filed: Nov. 8, 1996

[30] Foreign Application Priority Data

Nov. 10, 1995 [JP] Japan ..... 7-293154

[51] Int. Cl.[6] ..... G03C 1/08; G03C 7/26; G03C 7/32

[52] U.S. Cl. ..... 430/548; 430/543; 430/541; 430/548; 430/556; 430/557; 430/555; 430/558

[58] Field of Search ..... 430/543, 541, 430/548, 556, 557, 554, 555, 558

[56] References Cited

U.S. PATENT DOCUMENTS 5,141,844 8/1992 Lau ..... 430/548

5,360,710 11/1994 Chen et al. ..... 430/548

FOREIGN PATENT DOCUMENTS 55-6342 1/1980 Japan .

62-71950 4/1987 Japan .

62-148952 7/1987 Japan .

*Primary Examiner*—Geraldine Letscher

*Attorney, Agent, or Firm*—Burns, Doane, Swecker & Mathis, LLP

[57] ABSTRACT

A silver halide color photosensitive material comprising at least one polymer coupler, the polymer coupler being a copolymer prepared from at least one yellow coupler monomer and at least one magenta coupler monomer, and additionally, if desired, at least one non-color-forming monomer having at least one ethylene group, which has no capability to couple with an oxidized product of an aromatic primary amine developing agent. Further, a color filter produced from the above described color photosensitive material and a production method thereof are disclosed.

7 Claims, 3 Drawing Sheets

(R-LIGHT EXPOSURE)

(G-LIGHT EXPOSURE)

(B-LIGHT EXPOSURE)

(WHITE-LIGHT EXPOSURE)

SILVER HALIDE COLOR PHOTOSENSITIVE MATERIAL AND METHOD FOR PRODUCING COLOR FILTER USING THE SAME

FIELD OF THE INVENTION

The present invention relates to a silver halide color photosensitive material which forms a red color image having excellent spectral transmission characteristics and high fastness to heat and light. The invention also relates to a silver halide photosensitive material which is suitable for producing a color filter having a thin film thickness and excellent flatness, heat fastness and light fastness, a method for producing a color filter using the photosensitive material, and a color filter produced by the method. Furthermore, the invention relates to a silver halide photosensitive material suitable for easily producing a color filter having a black area of high density, a method for producing a color filter using the photosensitive material and a color filter produced by the method.

BACKGROUND OF THE INVENTION

A color filter is used in a color face plate for Braun tube display, a photoelectric conversion element plate for copying use, a single-tube color television camera filter, a flat panel display using liquid crystals, a color solid image pick-up element, etc.

A common color filter is generally constituted of regularly arranged red, green and blue colors (i.e., three primary colors), but it may have four or more different hues, if needed. For instance, color filters for use in an image pickup tube and a liquid crystal display apparatus require a black pattern (black matrix) for various purposes.

As for the way of arranging red, green and blue colors, mosaic, stripe and delta arrangements are exemplified as examples thereof. How to arrange those colors can be chosen so that the color filter meets requirements for the intended use.

Hitherto known methods for producing color filters include an evaporation method, a dyeing method, a printing method, a pigment dispersion method, an electrodeposition method, a resist electrodeposition transfer method, and so on. However, color filters obtained by these conventional methods have several disadvantages, such as involvement of complicated steps, liability to pinholes or scratches, poor yield, insufficient precision, etc.

In order to overcome these disadvantages, production of color filters using a silver halide photosensitive material of coupler-in-developer type (see JP-A-55-56342, the term "JP-A" as used herein means an "unexamined published Japanese patent application") or coupler-in-emulsion type (see JP-A-62-148952 and JP-A-62-71950) has been studied. However, the coupler-in-developer type development involves at least three times of color development and is not deemed to be simple and easy to carry out. In the coupler-in-emulsion type, on the other hand, the color filter obtained has a large thickness, and tends to suffer peeling during rubbing treatment in the production of an LCD panel or cutting of lines. In particular, it has been difficult to obtain a sharp pattern from the coupler-in-emulsion type color photosensitive material because the material have many photosensitive layer and therefore have a large thickness.

In order to solve those problems, it could be thought that the coating amount of a binder be reduced. However, it turned out that the reduction of a binder coating amount resulted in a relative increase of the proportion of low melting organic compounds in the coated layers to make the generated dyes diffuse easily under a high temperature, thereby causing a problem of providing a blurred pixel pattern. When used, for example, in color LCD, a color filter is unavoidably exposed to high temperatures above 150° C. in post-treatments, such as coating with a protective layer, vacuum deposition of a transparent electrode, and formation of an orientation film. Accordingly, the dyes used in a color filter are required to be fast and not to be diffused in such high temperatures. The dyes are also required to have high light fastness because color filters are to be exposed to back light for extended time periods.

SUMMARY OF THE INVENTION

Therefore, a first object of the present invention is to provide a silver halide color photosensitive material which forms a red image having excellent fastness to heat and light.

A second object of the present invention is to provide a color filter which is thin and reduced in pixel blur.

A third object of the present invention is to provide a color filter which has a red or black color highly fast to heat and light.

A fourth object of the present invention is to provide a color filter which does not require complicated processing steps, has suitability for mass production, hardly causes defects during the process of producing a LCD panel, and has excellent light-transmitting properties.

Other objects and effects of the present invention will be apparent from the following description.

It has been found that the above described objects of the present invention can be achieved by providing:

(1) a silver halide color photosensitive material comprising at least one polymer coupler selected from the group consisting of:

copolymers derived from at least one kind of yellow coupler monomer represented by the following formula (I) and at least one kind of magenta coupler monomer represented by the following formula (II); and couplers derived from at least one kind of yellow coupler monomer represented by the following formula (I), at least one kind of magenta coupler monomer represented by the following formula (II) and at least one kind of non-color-forming monomer having an ethylene group and no capability to couple with an oxidized product of an aromatic primary amine developing agent:

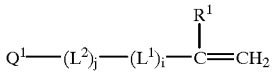

(I)

wherein $R^1$ represents a hydrogen atom, a chlorine atom, an alkyl group or an aryl group; $L^1$ represents —C(=O)N($R^2$)—, —C(=O)O—, —N($R^2$)C(=O)—, —OC(=O)—, or a group represented by the following formula (III), (IV) or (V); $R^2$ represents a hydrogen atom, an alkyl group, an aryl group or a heterocyclic group; $L^2$ represents a divalent linkage group connecting $L^1$ and $Q^1$; i represents 0 or 1; j represents 0 or 1; and $Q^1$ represents a yellow coupler residue capable of forming a yellow dye by coupling with an oxidized product of an aromatic primary amine developing agent;

(II)

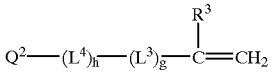

wherein $R^3$, $L^3$, $L^4$, g and h have the same meanings as $R^1$, $L^1$, $L^2$, i and j in the above formula (I), respectively; and $Q^2$ represents a magenta coupler residue capable of forming a magenta dye by coupling with an oxidized product of an aromatic primary amine developing agent;

(III)

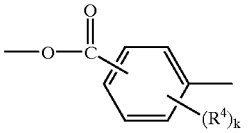

(IV)

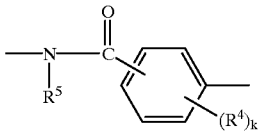

(V)

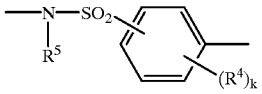

wherein $R^4$ represents a substitutent group, $R^5$ has the same meaning as $R^2$ in the above formula (I), and k represents an integer of from 0 to 4;

(2) the silver halide color photosensitive material as described in the above (1), which comprises a support having thereon at least three silver halide emulsion layers each having a different color sensitivity and containing couplers in such combination as to develop blue, green and red colors, respectively, by coupling with an oxidized product of an aromatic primary amine developing agent;

(3) a silver halide photosensitive material for color filter use, which comprises a support having thereon coated at least three silver halide emulsion layers each having a different color sensitivity, wherein at least one of the emulsion layers contains the polymer coupler as described in the above (1);

(4) the silver halide photosensitive material for color filter use as described in the above (3), wherein the silver halide emulsion layers contain couplers in such combination as to develop blue, green and red colors, respectively, by coupling with an oxidized product of an aromatic primary amine developing agent;

(5) the silver halide photosensitive material for color filter use as described in the above (3) or (4), further comprising at least one silver halide emulsion layer which is different in color sensitivity from the other emulsion layers and contains a coupler capable of making color compensation to produce a substantially black color having a transmission density of at least 2.5 upon reaction of all the couplers on the support;

(6) a method for producing a color filter having pixel patterns of blue, green and red colors, which comprises the steps of:

pattern-exposing the silver halide photosensitive material as described in the above (3), (4) or (5); and color developing and desilverizing the exposed material;

(7) a color filter produced by the method described in the above (6); and (8) a color filter comprising a dye formed by a coupling reaction of an oxidized product of an aromatic primary amine with the at least one polymer coupler as described in the above (1).

DETAILED DESCRIPTION OF THE INVENTION

Figure 1:
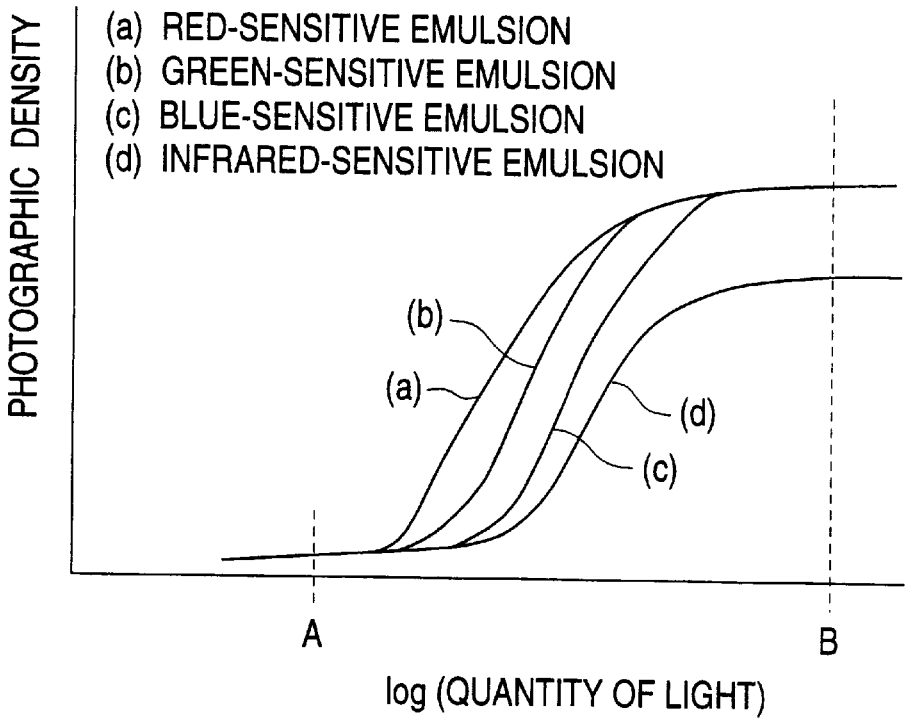
FIG. 1 is a graph showing the characteristic curves of the photosensitive material for use in the present invention.

The yellow coupler monomer represented by the above described formula (I) and magenta coupler monomer represented by the above described formula (II) are illustrated below in more detail.

$R^1$ in formula (I) and $R^3$ in formula (II) each represents a hydrogen atom, a chlorine atom, an alkyl group or an aryl group.

The alkyl group represents a straight chain, branched chain or cyclic, substituted or unsubstituted alkyl group generally containing 1 to 18, preferably 1 to 12, more preferably 1 to 8, carbon atoms, with specific examples including methyl, ethyl, propyl, butyl, pentyl, hexyl, heptyl, octyl, dodecyl, isopropyl, isobutyl, isoamyl, 2-ethylhexyl, cyclopropyl and cyclohexyl groups.

Specific examples of the substituent present in the substituted alkyl group include a halogen atom (e.g., fluorine, chlorine, bromine), a hydroxyl group, a cyano group, a carboxyl group, an aryl group (containing 6 to 18 carbon atoms, such as a phenyl or naphthyl group), an alkoxy group (containing 1 to 24 carbon atoms, such as a methoxy, ethoxy, propoxy, butoxy, dodecyloxy, hexadecyloxy, methoxyethoxy or isopropoxy group), an aryloxy group (containing 6 to 18 carbon atoms, such as a phenoxy, 4-chlorophenoxy or 2-methoxyphenoxy group), a heterocyclyloxy group (containing 2 to 12 carbon atoms, such as a 5-pyrazolyloxy or 2-pyridyloxy group), an alkylthio group (containing 1 to 18 carbon atoms, such as methylthio, ethylthio, butylthio, octylthio, dodecylthio or 2-ethylhexylthio group), an arylthio group (containing 6 to 18 carbon atoms, such as a phenylthio or naphthylthio group), an alkoxycarbonyl group (containing 2 to 24 carbon atoms, such as a methoxycarbonyl, ethoxycarbonyl, propyloxycarbonyl or octyloxycarbonyl group), an aryloxycarbonyl group (containing 7 to 16 carbon atoms, such as a phenoxycarbonyl, 4-ethoxyphenoxycarbonyl or 2,4-di-t-amylphenoxycarbonyl group), a carbonyloxy group (containing 2 to 24 carbon atoms, such as a methylcarbonyloxy, ethylcarbonyloxy, propylcarbonyloxy or heptacarbonyloxy group), an acylamino group (containing 2 to 18 carbon atoms, such as an acetylamino, butyramide, benzamido or pivalic acid amido group), a carbamoyl group (containing 1 to 18 carbon atoms, such as a carbamoyl, N-methylcarbamoyl, N-ethylcarbamoyl, N,N-diethylcarbamoyl, N-phenylcarbamoyl or N-cyclohexylcarbamoyl group), a sulfonamido group (containing 1 to 18 carbon atoms, such as a methanesulfonamido, ethanesulfonamido, butanesulfonamido or hexadecanesulfonamido group), a sulfamoyl group (containing 1 to 18 carbon atoms, such as an N-methylsulfamoyl, N-ethylsulfamoyl, N,N-dipropylsulfamoyl, N-phenylsulfamoyl or N-cyclohexylsulfamoyl group), an alkoxycarbonylamino group (containing 2 to 24 carbon atoms, such as a methoxycarbonylamino or ethoxycarbonylamino group), a carbamoylamino group (containing 2 to 18 carbon atoms, such as an N-methylcarbamoylamino, N,N-diethylcarbamoylamino or N-phenylcarbamoylamino group), an acyl group (containing 2 to 18 carbon atoms, such as an acetyl, benzoyl or pivaloyl group), an imido group (containing 3 to 21 carbon atoms, such as a succinimido, phthalimido or hydantoin-1-yl group), and a sulfonyl group (containing 1 to 24 carbon atoms, such as a methylsulfonyl, ethylsulfonyl or phenylsulfonyl group).

The aryl group represents a substituted or unsubstituted aryl group generally containing 6 to 12 carbon atoms, with the specific examples thereof including a phenyl group and a naphthyl group. As for the substituent of the substituted aryl group, alkyl groups as well as the substituents recited above as specific examples of the substituent in the above described substituted alkyl group are examples thereof. Examples of the alkyl groups with which the aryl group can be substituted include substituted or unsubstituted, straight chain, branched chain or cyclic alkyl groups each having an alkyl moiety containing 1 to 18 carbon atoms, preferably 1 to 4 carbon atoms, with examples including methyl, ethyl, isopropyl, t-butyl, octyl and dodecyl groups. Examples of a substituent attached to the alkyl moiety include the same groups as those exemplified as the substituent in the substituted alkyl group represented by $R^1$.

For $R^1$ and $R^3$ each, it is desirable to be a hydrogen atom or an alkyl group, more desirable to be a hydrogen atom or an unsubstituted alkyl group containing 1 to 4 carbon atoms, and most desirable to be a hydrogen atom or a methyl group.

$L^1$ in formula (I) and $L^3$ in formula (II) each represents —C(=O)N($R^2$)—, —C(=O)O—, —N($R^2$)C(=O)—, —OC(=O)—, or a group of the above described formula (III), (IV) or (V), wherein $R^2$ represents a hydrogen atom, an alkyl group, an aryl group or a heterocyclic group.

In formulae (III), (IV) and (V), $R^4$ represents a substituent group, $R^5$ has the same meaning as $R^2$, and k represents an integer of from 0 to 4.

$R^2$ and the above described formulae (III), (IV) and (V) are illustrated below in more detail.

The alkyl group represented by $R^2$ includes substituted and unsubstituted ones, the form of which can be a straight chain, branched chain or cycle, and the number of carbon atoms of which is generally from 1 to 36, preferably from 1 to 18, and more preferably from 1 to 8. Examples thereof include methyl, ethyl, propyl, butyl, hexyl, octyl, decyl, dodecyl, hexadecyl, isopropyl, isobutyl, 2-ethylhexyl, t-butyl, cyclohexyl and adamantyl groups. Examples of the substituent moiety in the substituted alkyl group represented by $R^2$ include the same groups as those exemplified as the substituent moiety in the substituted alkyl group illustrated above as $R^1$.

The aryl group represented by $R^2$ includes substituted and unsubstituted aryl groups, the number of carbon atoms of which is generally from 6 to 36, preferably from 6 to 24, and more preferably from 6 to 10. Examples thereof include a phenyl group and a naphthyl group. Examples of the substituent moiety in the substituted aryl group represented by $R^2$ include the same groups as those exemplified as the substituent moiety in the substituted aryl group illustrated above as $R^1$.

The heterocyclic group represented by $R^2$ includes 5- and 6-membered heterocyclic groups containing at least one N, O or S atom, such as pyrazolyl, imidazolyl, pyridyl, oxazolyl and thiazolyl groups. These heterocyclic groups each may have a substituent. Examples of the substituent of such a heterocyclic group include the same groups as those exemplified as the substituent moiety in the substituted aryl group illustrated above as $R^1$.

$R^2$ is desirably a hydrogen atom, an unsubstituted alkyl group or an unsubstituted aryl group, more desirably a hydrogen atom or an unsubstituted alkyl group, and most desirably a hydrogen atom.

$R^4$ in formulae (III), (IV) and (V) represents a substituent group, and k in those formulae represents an integer of from 0 to 4. $R^5$ has the same meaning as $R^2$.

Specific examples of a substituent group represented by $R^4$ include a halogen atom (e.g., fluorine, chlorine, bromine), a hydroxyl group, a cyano group, a carboxyl group, a sulfoxy group, a nitro group, an alkyl group (containing 1 to 36 carbon atoms, such as a methyl, ethyl, propyl, butyl, hexyl, octyl or hexadecyl group), an aryl group (containing 6 to 18 carbon atoms, such as a phenyl or naphthyl group), an alkoxy group (containing 1 to 24 carbon atoms, such as a methoxy, ethoxy, propoxy, butoxy, dodecyloxy, hexadecyloxy, methoxyethoxy or isopropoxy group), an aryloxy group (containing 6 to 18 carbon atoms, such as a phenoxy, 4-chlorophenoxy or 2-methoxyphenoxy group), a heterocyclyloxy group (containing 2 to 12 carbon atoms, such as a 5-pyrazolyloxy or 2-pyridyloxy group), an alkylthio group (containing 1 to 18 carbon atoms, such as a methylthio, ethylthio, butylthio, octylthio, dodecylthio or 2-ethylhexylthio group), an arylthio group (containing 6 to 18 carbon atoms, such as a phenylthio or naphthylthio group), an alkoxycarbonyl group (containing 2 to 24 carbon atoms, such as a methoxycarbonyl, ethoxycarbonyl, propyloxycarbonyl or octyloxycarbonyl group), an aryloxycarbonyl group (containing 7 to 16 carbon atoms, such as a phenoxycarbonyl, 4-ethoxyphenoxycarbonyl or 2,4-di-t-amylphenoxycarbonyl group), a carbonyloxy group (containing 2 to 24 carbon atoms, such as a methylcarbonyloxy, ethylcarbonyloxy, propylcarbonyloxy or heptacarbonyloxy group), an acylamino group (containing 2 to 18 carbon atoms, such as an acetylamino, butyramide, benzamido or pivalic acid amido group), a carbamoyl group (containing 1 to 18 carbon atoms, such as a carbamoyl, N-methylcarbamoyl, N-ethylcarbamoyl, N,N-diethylcarbamoyl, N-phenylcarbamoyl or N-cyclohexylcarbamoyl group), a sulfonamido group (containing 1 to 18 carbon atoms, such as a methanesulfonamido, ethanesulfonamido, butanesulfonamido or hexadecanesulfonamido group), a sulfamoyl group (containing 1 to 18 carbon atoms, such as an N-methylsulfamoyl, N-ethylsulfamoyl, N,N-dipropylsulfamoyl, N-phenylsulfamoyl or N-cyclohexylsulfamoyl group), an alkoxycarbonylamino group (containing 2 to 24 carbon atoms, such as a methoxycarbonylamino or ethoxycarbonylamino group), a carbamoylamino group (containing 2 to 18 carbon atoms, such as an N-methylcarbamoylamino, N,N-diethylcarbamoylamino or N-phenylcarbamoylamino group), an acyl group (containing 2 to 18 carbon atoms, such as an acetyl, benzoyl, pivaloyl or cyclohexanoyl group), an imido group (containing 3 to 21 carbon atoms, such as a succinimido, phthalimido, 3-hexadecenylsuccinimido or hydantoin-1-yl group), and a sulfonyl group (containing 1 to 24 carbon atoms, such as a methylsulfonyl, ethylsulfonyl or phenylsulfonyl group), and a heterocyclic group (containing 1 to 24 carbon atoms and at least one hetero atom, such as a nitrogen, oxygen or sulfur atom, and being a 3- to 12-membered, preferably 5- or 6-membered, monocyclic or condensed ring, with examples including 2-pyridyl, 1-pyrrolyl, morpholino, 1-pyrazolyl and 1-imidazolyl groups). These groups each may further have a substituent, $R^4$ is preferably a halogen atom, a hydroxyl group, a cyano group, a carboxyl group, an alkyl group, an aryl group, an alkoxy group, an aryloxy group, an alkylthio group, an arylthio group, an alkoxycarbonyl group, a carbonyloxy group, an acylamino group, a carbamoyl group, a sulfonamido group, a sulfamoyl group, an alkoxycarbonylamino group, a carbamoylamino group or a sulfonyl group. More preferably, $R^4$ is a halogen atom, a hydroxyl group, an alkoxy group, an alkylthio group, an alkoxycarbonyl group, an acylamino group, a carbamoyl group, a sulfonamido group or a sulfamoyl group. Particularly preferably, $R^4$ is a halogen atom, a hydroxyl group, an alkoxy group, an alkoxycarbonyl group, an acylamino group, a carbamoyl group, a sulfonamido group and a sulfamoyl group.

k represents an integer of from 0 to 4. When k is 2, 3 or 4, a plurality of $R^4$ groups may be the same or different.

k is desirably 0, 1 or 2, and more desirably 0 or 1. Most desirably, k is 0.

$L^2$ in formula (I) and $L^4$ in formula (II) each represents a linkage group, and specifically represented by the following formula (VI):

$$-(X^1-(J^1-X^2)_r-(J^2-X^3)_q-(J^3)_s)- \quad \text{(VI)}$$

In the above formula, $J^1$, $J^2$ and $J^3$ are the same or different, and each of them represents $-R^7-$, $-C(=O)-$, $-SO_2-$, $-C(=O)N(R^6)-$, $-SO_2N(R^6)-$, $-N(R^6)R^7-$, $-N(R^6)R^7N(R^8)-$, $-O-$, $-S-$, $-N(R^6)C(=O)N(R^8)-$, $-N(R^6)SO_2N(R^8)-$, $-C(=O)O-$, $-OC(=O)-$, $-N(R^8)C(=O)O-$, $-N(R^6)C(=O)-$, $-OC(=O)N(R^6)-$ or $-HN(R^6)SO_2-$.

$R^6$ represents a hydrogen atom, an alkyl group or an aryl group, $R^7$ represents an alkylene group, an aralkylene group or an arylene group, and $R^8$ represents a hydrogen atom, an alkyl group or an aryl group.

$X^1$, $X^2$ and $X^3$ are the same or different, and each of them represents an alkylene group, an arylene group or an aralkylene group. q, r and s each represent 0 or 1.

$R^6$, $R^7$, $R^8$, $X^1$, $X^2$ and $X^3$ are each illustrated below in more detail.

$R^6$ and $R^8$ each represent a hydrogen atom, an alkyl group or an aryl group. The alkyl group as $R^6$ and $R^8$ is a substituted or unsubstituted, straight chain, branched chain or cyclic alkyl group. The alkyl group has the same meaning as the alkyl group defined above as $R^2$, and the substituent in the substituted alkyl group has the same meaning as the substituent defined above as the substituent in the substituted alkyl group represented by $R^1$, the aryl group as $R^6$ and $R^8$ is a substituted or unsubstituted aryl group, and the substituent of the substituted aryl group has the same meaning as the substituent group represented by $R^4$ as defined above. $R^6$ and $R^8$ may be the same, or different from each other.

$R^6$ and $R^8$ each is preferably a hydrogen atom or an alkyl group, more preferably a hydrogen atom or an unsubstituted alkyl group. Particularly preferably, $R^6$ and $R^8$ each is a hydrogen atom and a straight or branched chain, unsubstituted alkyl group containing 1 to 18 carbon atoms.

$R^7$ represents an alkylene group, an aralkylene group or an arylene group.

The alkylene group as $R^7$ is a substituted or unsubstituted, straight chain, branched chain or cyclic alkylene group, the alkylene moiety of which generally contains 1 to 18, preferably 1 to 12, more preferably 1 to 6, carbon atoms, with examples including methylene, ethylene, propylene, butylene, hexylene, methylmethylene, ethylmethylene, dimethylmethylene, cyclohexylene and phenylmethylene groups. The substituent in the substituted alkylene group has the same meaning as the substituent group represented by $R^4$ as defined above.

The aralkylene group as $R^7$ is a substituted or unsubstituted aralkylene group generally containing 7 to 18, preferably 7 to 12, carbon atoms, and examples of the aralkylene moiety thereof include benzylene and phenethylene. The substituent in the substituted aralkylene group has the same meaning as the substituent group represented by $R^4$ as defined above.

The arylene group as $R^7$ is a substituted or unsubstituted arylene group generally containing 6 to 18, preferably 6 to 10, carbon atoms, and examples of the arylene moiety thereof include phenylene (ortho, meta and para) and naphthylene. The substituent in the substituted arylene group has the same meaning as the substituent group represented by $R^4$ as defined above.

$X^1$, $X^2$ and $X^3$ may be the same or different, and each of them represents an alkylene group, an arylene group or an aralkylene group. The alkylene group is a substituted or unsubstituted, straight chain, branched chain or cyclic alkylene group, the arylene group is a substituted or unsubstituted arylene group, and the aralkylene group is a substituted or unsubstituted aralkylene group. These groups have the same meanings as those defined above as $R^7$, respectively.

q, r and s are each 0 or 1.

$Q^1$ represents a yellow coupler residue, with examples including coupler residues or pivaloylacetanilide type, benzoylacetanilide type, malonic acid diester type, malonic acid diamide type, dibenzoylmethane type, benzothiazolylacetamide type, malonic acid ester monoamide type (e.g., those described in JP-A-05-31332), benzoxazolylacetamide type, benzimidazolylacetamide type, and cycloalkanolylacetamide type (e.g., those described in JP-A-04-218042). In addition, $Q^1$ may be a coupler residue selected from those described, e.g., in U.S. Pat. Nos. 5,021,332, 5,021,330 and 5,213,958, EP-A-0421221 and European Patent 482,552.

Preferred examples of a yellow coupler residue represented by $Q^1$ are those represented by the following formulae (Cp-1) and (Cp-2), each of which are attached to linkage group $L^2$ or $L^1$ via any of substituents $R^{51}$, $R^{52}$ and $R^{53}$;

Formula (Cp-1)

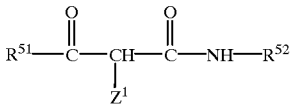

-continued

Formula (Cp-2)

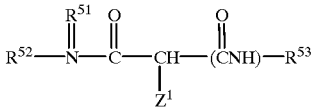

In the above formulae, $R^{51}$, $R^{52}$ and $R^{53}$ each represents an alkyl group, an alkenyl group, an aryl group or a heterocyclic group; b represents 0 or 1; and $Q^1$ represents a hydrogen atom or a group which dissociates itself upon reaction with an oxidized product of an aromatic primary amine developing agent.

The substituents $R^{51}$, $R^{52}$ and $R^{53}$, $Q^1$ and b are each illustrated below in more detail.

The alkyl group as the substituents $R^{51}$, $R^{52}$ and $R^{53}$ is a substituted or unsubstituted, straight chain, branched chain or cyclic alkyl group, the alkyl moiety of which contains 1 to 36, preferably 1 to 18, more preferably 1 to 12, carbon atoms, with specific examples including methyl, ethyl, propyl, butyl, pentyl, hexyl, heptyl, octyl, isopropyl, isobutyl, 2-ethylhexyl, t-butyl, t-octyl, cyclopropyl, cyclobutyl, cyclopentyl, cyclohexyl, methylcyclopropyl, ethylcyclopropyl, methylcyclobutyl and benzylcyclopropyl groups. The substituent in the substituted alkyl group has the same meaning as the substituent defined above as the substituent in the substituted alkyl group represented by $R^1$.

the alkenyl group as the substituents $R^{51}$, $R^{52}$ and $R^{53}$ is a substituted or unsubstituted alkenyl group generally containing 2 to 36, preferably 2 to 18, carbon atoms, with specific examples including ethylenyl, propenyl, butenyl, hexenyl, hexadecenyl and octadecenyl groups.

The aryl group as the substituents $R^{51}$, $R^{52}$ and $R^{53}$ is a substituted or unsubstituted aryl group generally containing 6 to 36, preferably 6 to 18, carbon atoms. The substituent in the substituted aryl group has the same meaning as the substituent group represented by $R^4$ as defined above.

The heterocyclic group as the substituents $R^{51}$, $R^{52}$ and $R^{53}$ is a 3- to 12-membered, preferably 5- or 6-membered, monocyclic group or condensed ring residue containing at least one nitrogen, oxygen or sulfur atom, which may have a substituent.

$Q^1$ represents a hydrogen atom or a group capable of dissociating itself by the reaction with an oxidized product of an aromatic primary amine developing agent, with examples including halogen atoms (fluorine, chlorine, bromine, iodine), heterocyclic groups and imido groups each capable of dissociating itself at the site of nitrogen atom (e.g., the dissociative groups described in JP-A-56-38044, JP-B-10739 (the term "JP-B" as used herein means an "examined Japanese patent publication"), JP-B-56-54134, JP-B-56-54135), alkylthio groups (e.g., the dissociative groups described in JP-A-56-126833), arylthio groups (e.g., the dissociative groups described in U.S. Pat. No. 4,351,897 and JP-A-02-160233), alkoxy groups (e.g., the dissociative groups described in European Patent 0423727), aryloxy groups (e.g., the dissociative groups described in European Patents 428,902 and 299,726), the dissociative groups described in U.S. Pat. No. 4,072,525, JP-A-05-34878, JP-A-05-313322, European Patent 514,896, JP-A-06-347960 and JP-A-07-48376, and a carbonyloxy group and a carbamoyloxy group.

Specific examples of a group capable of dissociating itself at the site of nitrogen atom include imido groups (such as succinimido, phthalimido and hydantoin-1-yl), a pyrazolyl group, an imidazolyl group and a triazolyl group. These groups each may be condensed with a 5- 6-membered heterocyclic ring or aromatic ring. In addition, these groups each may be substituted with one or more groups included in those defined above as the substituent in the substituted aryl group represented by $R^1$.

The above described alkylthio group generally contains 1 to 24 carbon atoms, preferably 2 to 18 carbon atoms, with specific examples thereof including 2-hydroxyethylthio, ethoxycarbonylmethylthio, carboxymethylthio, 2-carboxyethylthio, dodecylthio, 1-ethoxycarbonyldodecylthio, hexyloxyethylthio, benzylthio and 1-benzyloxycarbonyloctylthio groups.

The above described arylthio group generally contains 6 to 24 carbon atoms, preferably 6 to 18 carbon atoms, with specific examples thereof including phenylthio, 2-butoxy-5-octylphenylthio, 2-pivaloylaminophenylthio and 2-benzyloxycarbonylphenylthio groups.

The above described aryloxy group generally contains 6 to 24 carbon atoms, preferably 6 to 18 carbon atoms, with specific examples thereof including phenoxy, 4-methylphenoxy, 4-methoxycarbonylphenoxy, 4-ethoxycarbonylphenoxy, 4-carboxyphenoxy, 4-chlorophenoxy and 3-ethylphenoxy groups.

Most desirable examples of the yellow coupler residue represented by $Q^1$ are those represented by the following formula (Cp-3), (Cp-4) and (Cp-5), each of which are attached to linkage group $L^2$ or $L^1$ via any of substituents $R^{54}$, $R^{55}$, $R^{56}$ and $R^{57}$:

Formula (Cp-3)

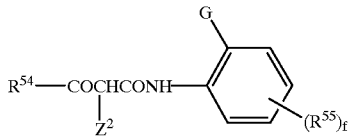

Formula (Cp-4)

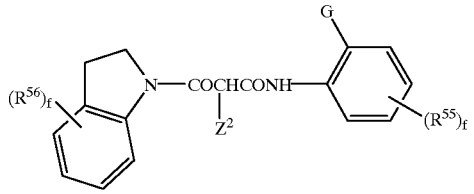

Formula (Cp-5)

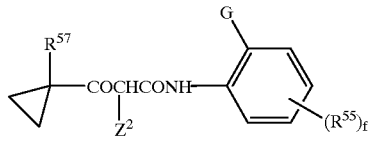

wherein $R^{54}$ represents a tertiary alkyl group, G represents a substituent group, $R^{55}$ and $R^{56}$ each represents a substituent group, f represents an integer of from 0 to 4, $Z^2$ represents a hydrogen atom or a group capable of dissociating itself by the reaction with an oxidized product of an aromatic primary amine developing agent. $R^{57}$ represents an alkyl group or an aralkyl group.

$R^{54}$, $R^5$, $R^{56}$, $R^{57}$, G, f and $Z^2$ are each illustrated below in more detail.

$R^{54}$ represents a substituted or unsubstituted chain-form or cyclic tertiary alkyl group. Specific examples of such a tertiary alkyl group include those containing 4 to 36 carbon atoms, preferably 4 to 18 carbon atoms, such as t-butyl, t-octyl, methylcyclopropyl, ethylcyclopropyl, benzylcyclopropyl, ethylcyclobutyl, methylcyclohexyl and adamantyl groups. The substituent in the substituted tertiary alkyl group as $R^{54}$ has the same meaning as that of the substituent in the substituted alkyl group defined as $R^1$ hereinbefore. $R^{54}$ is preferably an unsubstituted tertiary alkyl group having a chain or cyclic form. More preferably, $R^{54}$ is a t-butyl or adamantyl group. Particularly preferably, $R^{54}$ is a t-butyl group.

G represents a substituent, and has the same meaning as the substituent represented by $R^4$ as defined above. Suitable examples of such a substituent include a halogen atom, an alkoxy group, an aryloxy group, an alkylthio group, an arylthio group, a heterocyclylthio group, an ester group, an amido group, a sulfonamido group and a heterocyclic group. Of these substituents, a halogen atom, an alkoxy group, an aryloxy group, an alkylthio group and an arylthio group are preferred. Most preferably, the substituent represented by G is a halogen atom (e.g., fluorine, chlorine), an alkoxy group (containing 1 to 36 carbon atom, preferably 1 to 18 carbon atoms, such as methoxy, ethoxy, propoxy, isopropoxy, butoxy, 2-ethylhexyloxy, dodecyloxy or hexadecenyloxy), or an aryloxy group (containing 6 to 24 carbon atoms, preferably 6 to 12 carbon atoms, such as phenoxy, 2-methoxyphenoxy, 4-methoxyphenoxy, 4-methylphenoxy or 4-t-butylphenoxy).

$R^{55}$ and $R^{56}$ each represents a substituent, and the substituent has the same meaning as the substituent of the group defined as $R^4$. Suitable examples of such a substituent include a halogen atom, a carbonamido group, a sulfonamido group, an ester group, a carbamoyl group, a sulfamoyl group, an alkoxy group, an aryloxy group, an alkylthio group, an arylthio group, an alkyl group and an aryl group. Of these groups, a halogen atom, a carbonamido group, a sulfonamido group, an ester group, a carbamoyl group or a sulfamoyl group are preferred. Particularly preferably, each of $R^{55}$ and $R^{56}$ are a halogen atom, a carbonamido group, an ester group or a carbamoyl group.

f represents an integer of from 0 to 4. When f is from 2 to 4, a plurality of $R^{55}$ groups and a plurality of $R^{56}$ groups may be the same or different. f of $(R^{55})_f$ is preferably 1 or 2, and f of $(R^{56})_f$ is preferably 0.

$Z^2$ represents a hydrogen atom or a group capable of dissociating itself upon reaction with an oxidized product of an aromatic primary amine developing agent, and has the same meaning as $Z^1$ defined hereinbefore. Suitable examples of the dissociative group represented by $Z^2$ include heterocyclic groups and imido groups of the type which have a nitrogen atom at the dissociation site, an alkylthio group, an arylthio group, an alkoxy group and an aryloxy group. Of these groups, the above described type of heterocyclic group and imido group, an alkylthio group, an arylthio group and an aryloxy group are preferred. Most preferably, $Z^2$ is a heterocyclic or imido group of the type which has a nitrogen atom at the dissociation site.

$R^{57}$ represents an alkyl or aralkyl group. Specifically, the alkyl group as $R^{57}$ is a substituted or unsubstituted, straight or branched chain alkyl group. The substituent of the substituted alkyl group as $R^{57}$ has the same meaning as the substituent in the substituted alkyl groups represented by $R^1$ as defined above. The aralkyl group as $R^{57}$ include substituted and unsubstituted aralkyl groups. The substituent in the substituted aralkyl group as $R^{57}$ has the same meaning as the substituent represented by $R^4$ as defined above. More specifically, $R^{57}$ is preferably a straight or branched chain, unsubstituted alkyl group containing 1 to 12 carbon atoms or a benzyl group. Of these groups, methyl, ethyl, propyl, butyl, isopropyl, isobutyl and benzyl groups are preferred. Most preferably, $R^{57}$ is a methyl, ethyl, propyl or benzyl group.

$Q^2$ in formula (II) represents a magenta coupler residue, with examples including coupler residues of 5-pyrazolone type, pyrazolobenzimidazole type, pyrazolotriazole type, pyrazoloimidazole type, imidatriazole type and cyanoacetophenone type.

Suitable examples of the magenta coupler residue are those represented by the following formulae (Cp-6), (Cp-7), (Cp-8), (Cp-9) and (Cp-10):

Formula (Cp-6)

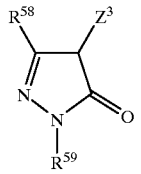

Formula (Cp-7)

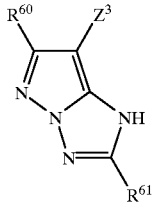

Formula (Cp-8)

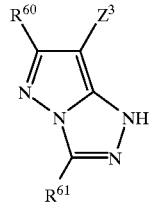

Formula (Cp-9)

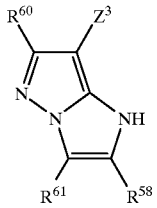

Formula (Cp-10)

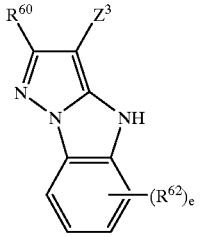

wherein $R^{58}$, $R^{60}$, $R^{61}$ and $R^{62}$ each represents a substituent; $R^{59}$ represents an alkyl group, an aryl group or a heterocyclic group; e represents an integer of from 0 to 4; and $Z^3$ represents a hydrogen atom or a group capable of dissociating itself upon reaction with an oxidized product of an aromatic primary amine developing agent. Each of the above shown coupler residues is attached to linkage group $L^1$ or $L^2$ via any of substituents $R^{58}$, $R^{59}$, $R^{60}$, $R^{61}$ and $R^{62}$.

$R^{58}$, $R^{59}$, $R^{60}$, $R^{61}$, $R^{62}$, $Z^3$ and e are described below in more detail.

In the following description, $R^{41}$ represents an alkyl group, an aryl group or a heterocyclic group, and $R^{42}$, $R^{43}$ and $R^{44}$ each represents a hydrogen atom, an alkyl group, an aryl group or a heterocyclic group. Herein, these alkyl, aryl and heterocyclic groups may be substituted and have the same meanings as those defined as $R^2$, respectively.

$R^{56}$ represents the same alkyl, aryl or heterocyclic group that $R^{41}$ means, a group of formula $R^{41}$—C(=O)N($R^{42}$)—, a group of formula $R^{41}$—$SO_2$—N($R^{42}$)—, a group of formula $R^{41}$N($R^{42}$)—, a group of formula $R^{41}$S—, a group of formula $R^{42}$O—, or a group of formula $R^{44}$N($R^{42}$)C(=O)N($R^{45}$)—. It is preferable for $R^{58}$ to be the same alkyl, aryl or heterocyclic group that $R^{41}$ means, a group of formula $R^{41}$—C(=O)N($R^{42}$)—, a group of formula $R^{41}$—$SO_2$—N($R^{42}$)—, a group of formula $R^{41}$N($R^{42}$)—, or a group of formula $R^{44}$N($R^{42}$)C(=O)N($R^{45}$)—. Of these groups, $R^{41}$—C(=O)N($R^{42}$)—, $R^{41}$N($R^{42}$)— and $R^{44}$N($R^{42}$)C(=O)N($R^{45}$)— are more preferable. The most preferred $R^{58}$ is $R^{41}$—C(=O)N($R^{42}$)— or $R^{41}$N($R^{42}$)—.

$R^{59}$ represents the same alkyl, aryl or heterocyclic group that $R^{41}$ means.

$R^{60}$ and $R^{61}$ each represents what $R^{42}$ means, a group of formula $R^{41}$S—, a group of formula $R^{42}$O—, a group of formula $R^{41}$—C(=O)N($R^{42}$)—, a group of formula $R^{41}$—$SO_2$—N($R^{42}$)—, a group of formula $R^{41}$N($R^{42}$)—, a group of formula $R^{41}SO_2$—, a cyano group or an imido group. It is preferable for $R^{60}$ to be what $R^{42}$ means, a group of formula $R^{41}$S—, a group of formula $R^{42}$O—, a group of formula $R^{41}$—C(=O)N($R^{42}$)—, a group of formula $R^{41}$N($R^{42}$)—, a group of formula $R^{41}$O—C(=O)N($R^{42}$)—, a group of formula $R^{44}$N($R^{42}$)C(=O)N($R^{45}$)—, or an imido group. Of these groups, the same group that $R^{41}$ means, $R^{41}$S—, $R^{42}$O— and $R^{41}$N($R^{42}$)— are more preferable. The most preferred $R^{60}$ is the same group that $R^{41}$ means, or a group of formula $R^{41}$O—.

$R^{61}$ is preferably what $R^{42}$ means, a group of formula $R^{42}$O—, a group of formula $R^{41}$—C(=O)N($R^{42}$)—, a group of formula $R^{41}$N($R^{42}$)—, a group of formula $R^{41}$O—C(=O)NR($R^{42}$)—, or a group of formula $R^{44}$N($R^{42}$)C(=O)N($R^{43}$)—. Of these groups, what $R^{42}$ means, a group of formula $R^{42}$O— and a group of formula $R^{41}$—C(=O)N($R^{42}$)— are more preferable. The most preferred $R^{41}$ is the same group that $R^{41}$ means.

$R^{42}$ represents the same group that $R^{41}$ means, a group of formula $R^{42}$C(=O)N($R^{43}$)—, a group of formula $R^{42}$N($R^{43}$)C(=O)—, a group of formula $R^{41}$—$SO_2$—N($R^{42}$)—, a group of formula $R^{41}$N($R^{42}$)$SO_2$—, a group of formula $R^{41}SO_2$—, a group of formula $R^{43}$O—C(=O)—, a halogen atom, a nitro group, a cyano group, a formyl group, a hydroxyl group, an imido group, a group of formula $R^{41}$N($R^{42}$)—, or a group of formula $R^{41}$C(=O)—. e represents an integer of from 0 to 4. When e is from 2 to 4, a plurality of $R^{62}$ groups may be the same or different.

$Z^3$ has the same meaning as $Z^1$ defined hereinbefore. Preferably, $Z^3$ is a halogen atom (fluorine, chlorine, bromine or iodine), a heterocyclic group capable of dissociating itself at the site of nitrogen atom, an alkylthio group, an arylthio group or an aryloxy group. Of these groups, a halogen atom (chlorine), a heterocyclic group capable of dissociating itself at the site of nitrogen atom, an alkylthio group, an arylthio group and an aryloxy group are more preferable. In particular, a pyrazolyl group and a chlorine atom are preferred.

As for $Q^2$, coupler residues represented by formulae (Cp-7), (Cp-8) and (Cp-9) are preferable, those represented by formulae (Cp-7) and (Cp-8) are more preferable, and those represented by formula (Cp-7) are most preferable.

Preferred embodiments of the coupler monomers of formulae (I) and (II) are described below.

As for the yellow coupler monomers represented by formula (I), it is desirable that $Q^1$ be represented by the above described formula (Cp-1) or (Cp-2), $R^1$ be a hydrogen atom or an alkyl group, $L^1$ be a linkage group of formula —C(=O)N($R^2$)—, —C(=O)O—, —N($R^2$)C(=O—)— or —OC(=O)—, or that of formula (III), (IV) or (V) illustrated hereinbefore, i be 0 or 1, $R^2$ be a hydrogen atom, an unsubstituted alkyl group or an unsubstituted aryl group, $L^2$ be a divalent linkage group (an alkylene, arylene or aralkylene group) and j be 0 or 1.

More desirable yellow coupler monomers are the monomers of formula (I) wherein $Q^1$ is represented by the above described formula (Cp-3), (Cp-4) or (Cp-5), $R^1$ is a hydrogen atom or an alkyl group, $L^1$ is —N($R^2$)C(=O)—, —OC(=O)— or a linkage group of the above described formula (III), (IV) or (V), i is 1, $R^2$ is a hydrogen atom, an unsubstituted alkyl group or an unsubstituted aryl group, $L^2$ is a divalent linkage group (an alkylene, arylene or aralkylene group) and j is 0 or 1.

Most desirable yellow coupler monomers are those of formula (I) wherein $Q^1$ is represented by the above described formula (Cp-3), (Cp-4) or (Cp-5), $R^1$ is a hydrogen atom or an unsubstituted alkyl group containing 1 to 4 carbon atoms, $L^1$ is —N($R^2$)C(=O)—, —OC(=O)— or a linkage group of the above described formula (III), (IV) or (V), i is 1, $R^2$ is a hydrogen atom, an unsubstituted alkyl group or an unsubstituted aryl group, $L^2$ is a divalent linkage group (an alkylene, arylene or aralkylene group) and j is 0 or 1.

As for each of the substituents in the formulae (Cp-3), (Cp-4), (Cp-5), (III), (IV) and (V), a desirable scope thereof is as described above.

Preferred embodiments of the magenta coupler monomer represented by formula (II) as follows.

It is desirable for the magenta coupler monomer of formula (II) that $Q^2$ be represented by the above described formula (Cp-6), (Cp-7), (Cp-8), (Cp-9) or (Cp-10), $R^3$ be a hydrogen atom or an alkyl group, $L^1$ be —C(=O)N($R^2$)—, —C(=O)O—, —N($R^2$)C(=O—), —OC(=O)— or a linkage group of formula (III), (IV) or (V) illustrated hereinbefore, i be 0 or 1, $R^2$ be a hydrogen atom, an unsubstituted alkyl group or an unsubstituted aryl group, $L^2$ be a divalent linkage group (an alkylene, arylene or aralkylene group) and j be 0 or 1.

More desirable magenta coupler monomers are the monomers of formula (II) wherein $Q^2$ is represented by the above described formula (Cp-7) or (Cp-8), $R^3$ is a hydrogen atom or an alkyl group, $L^1$ is —N($R^2$)C(=O)—, —OC(=O)— or a linkage group of the above described formula (III), (IV) or (V), i is 1, $R^2$ is a hydrogen atom, an unsubstituted alkyl group or an unsubstituted aryl group, $L^2$ is a divalent linkage group (an alkylene, arylene or aralkylene group) and j is 0 or 1.

Most desirable magenta coupler monomers are those of formula (II) wherein $Q^2$ is represented by the above described formula (Cp-7), $R^3$ is a hydrogen atom or an alkyl group containing 1 to 4 carbon atoms, $L^1$ is —N($R^2$)C(=O)—, —OC(=O)— or a linkage group of the above described formula (III), (IV) or (V), i is 1, $R^2$ is a hydrogen atom, $L^2$ is a divalent linkage group (an alkylene, arylene or aralkylene group) and j is 0 or 1.

As for each of the substituents in the formulae (Cp-6) to (Cp-10) and the formulae (III) to (V), a desirable scope thereof is as described above.

Specific examples of the yellow coupler monomer for use in the present invention are shown below. However, the invention should not be construed as being limited to these examples.

Y-1
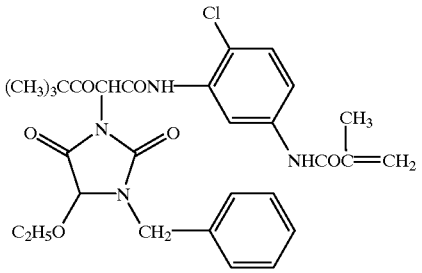
Y-2
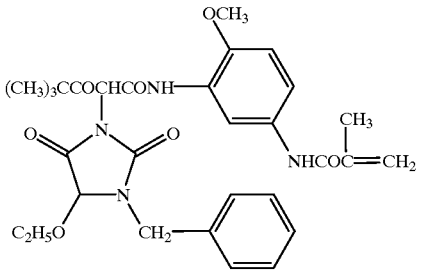
Y-3
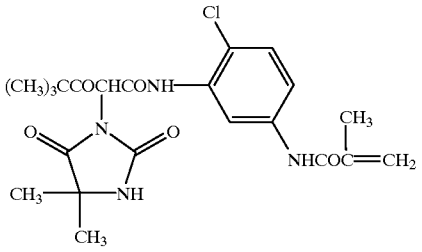
Y-4
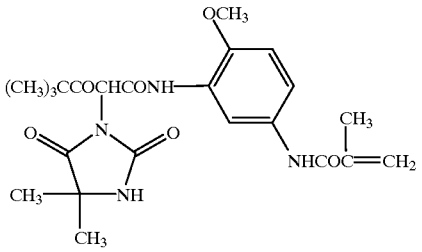
Y-5
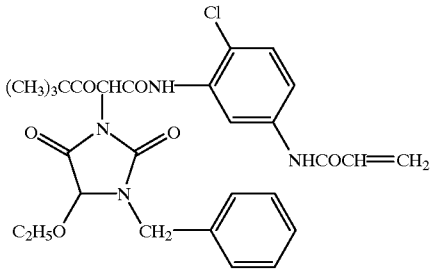
-continued
Y-6
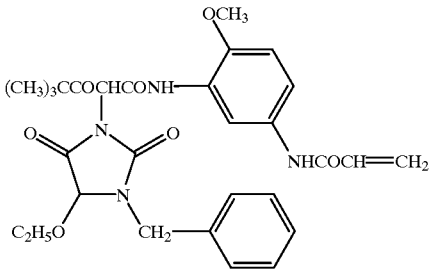
Y-7
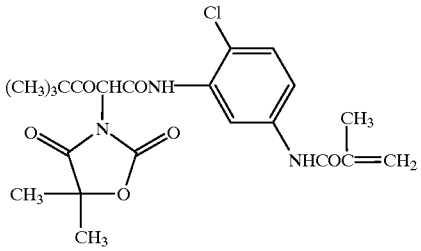
Y-8
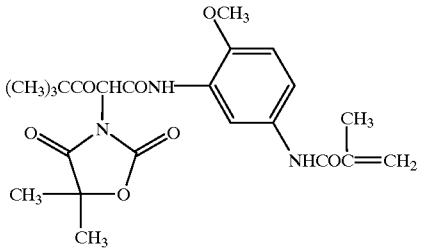
Y-9
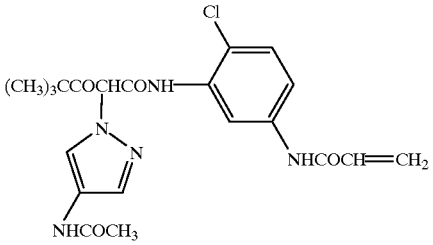
Y-10
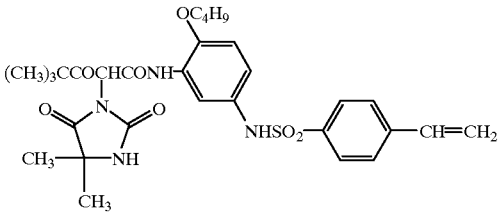
Y-11
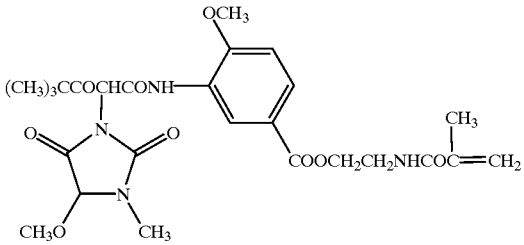

-continued
Y-12
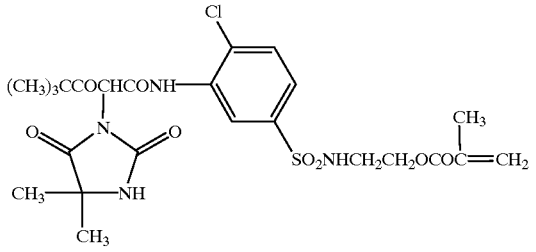
Y-13
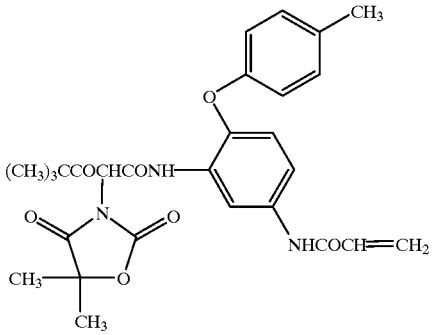
Y-14
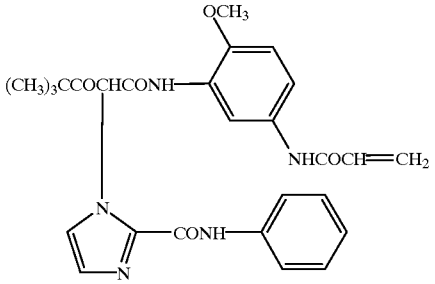
Y-15
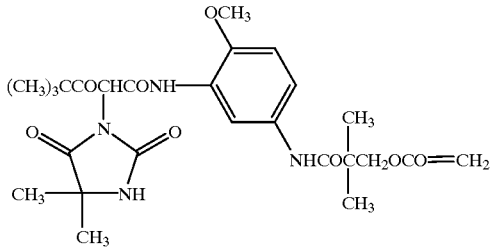
Y-16
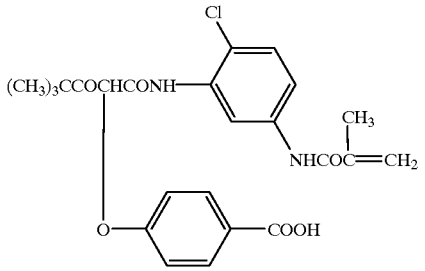
-continued
Y-17
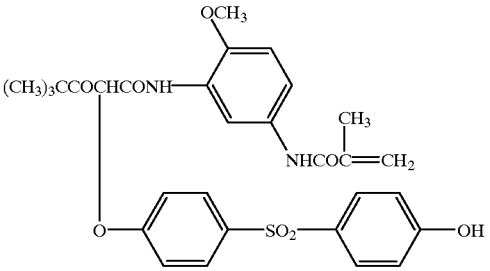
Y-18
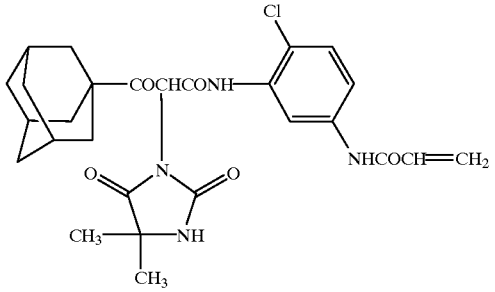
Y-19
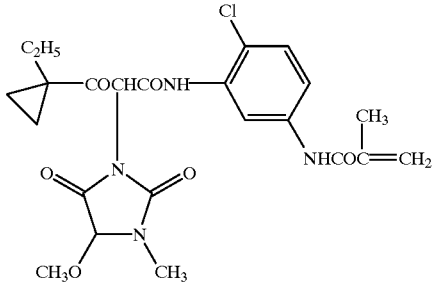
Y-20
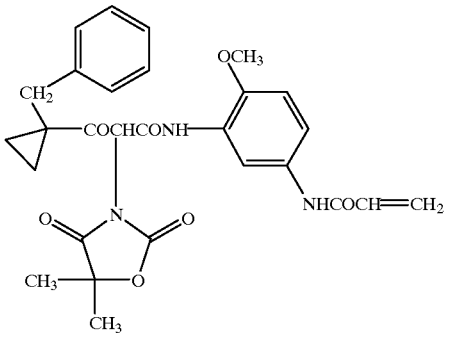
Y-21
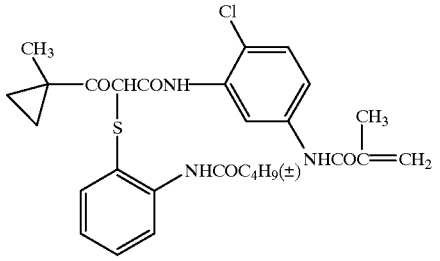

-continued
Y-22
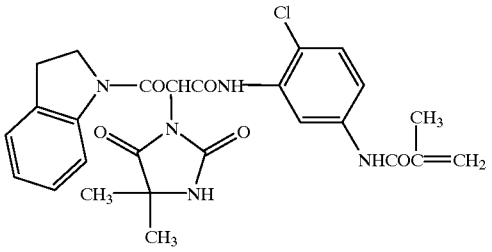
Y-23
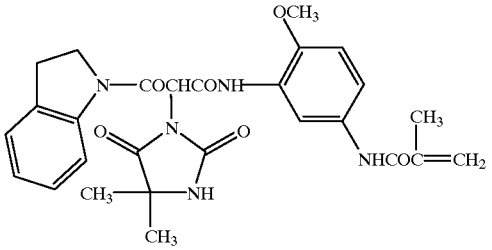
Y-24
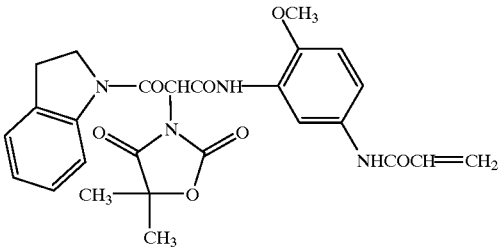
Y-25
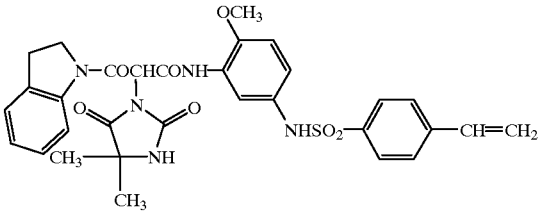
Y-26
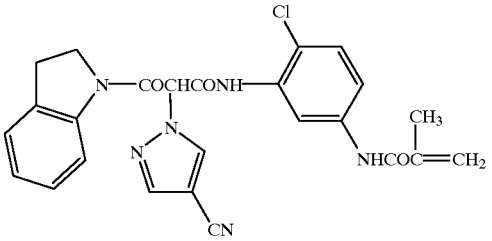
-continued
Y-27
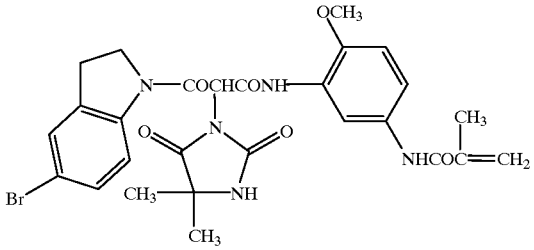
Y-28
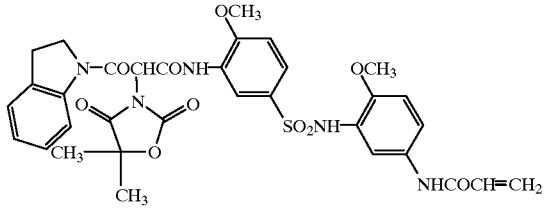
Y-29
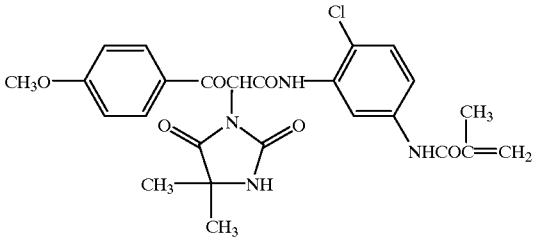
Y-30
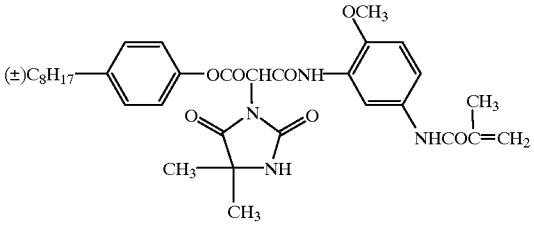
Y-31
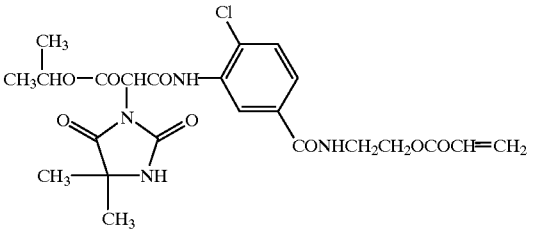
Y-32
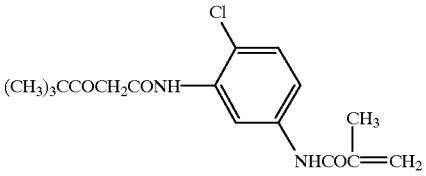

-continued
Y-33
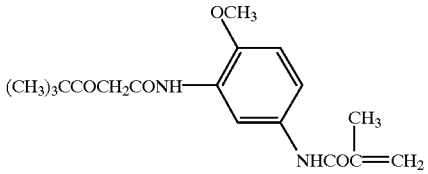
Y-34
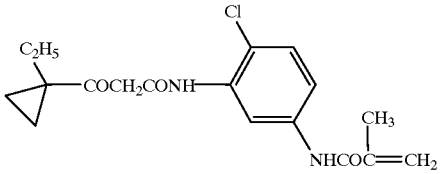
Y-35
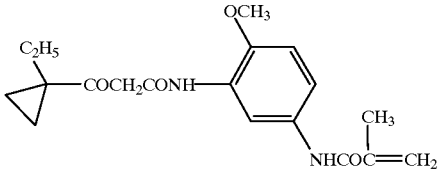
Y-36
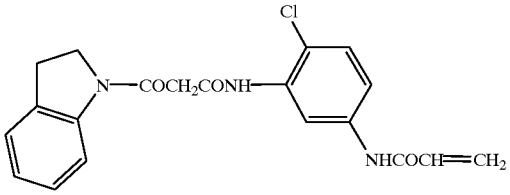
Y-37
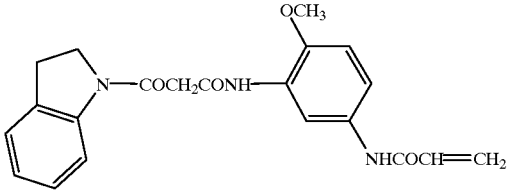
Y-38
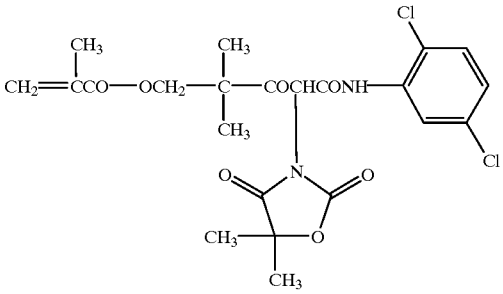
Y-39
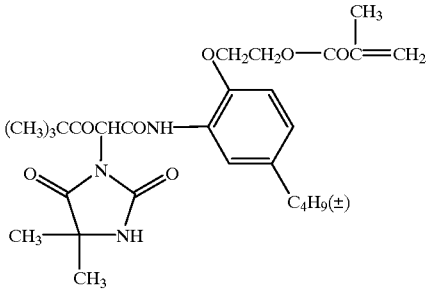
-continued
Y-40
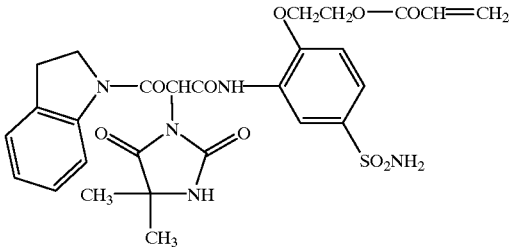
Specific examples of the magenta coupler monomer for use in the present invention are shown below. However, the invention should not be construed as being limited to these examples.
M-1
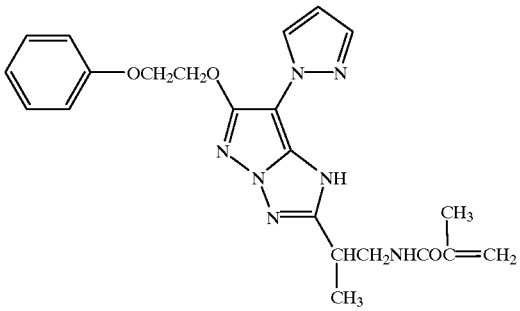
M-2
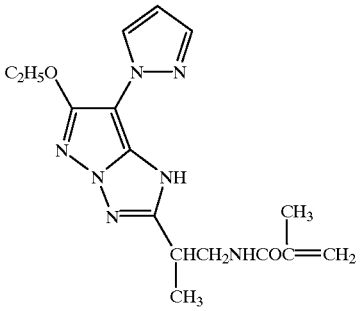
M-3
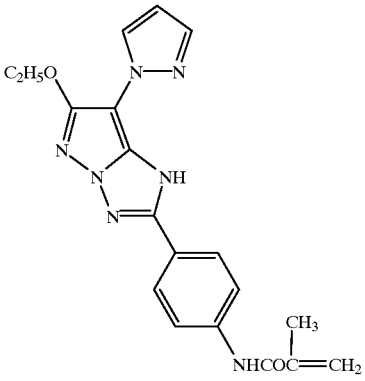

-continued
M-4
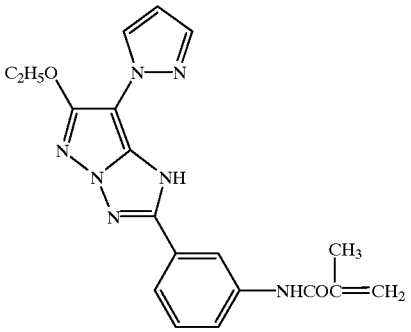
M-5
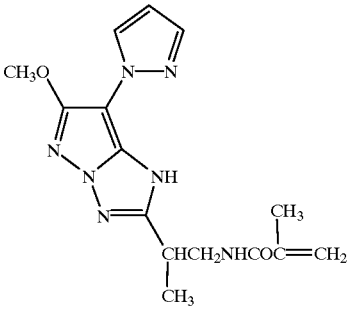
M-6
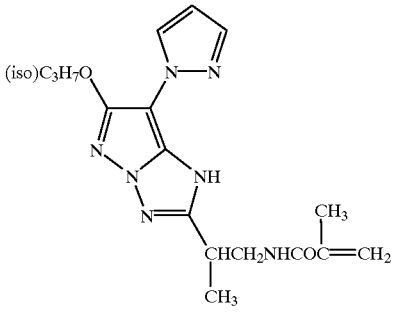
M-7
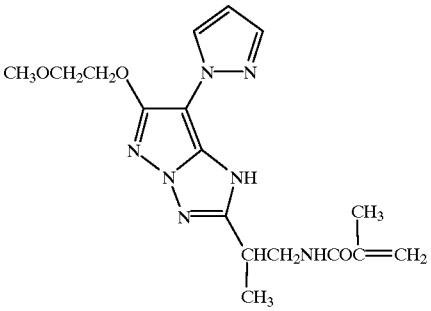
-continued
M-8
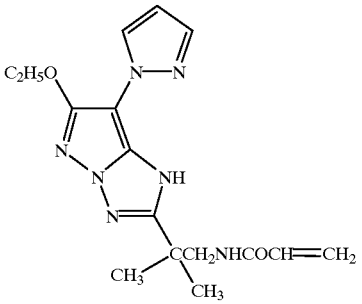
M-9
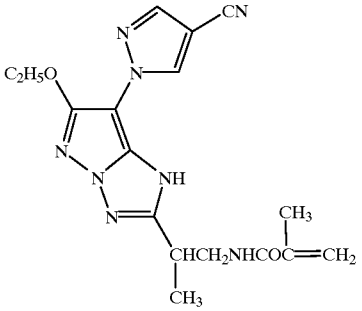
M-10
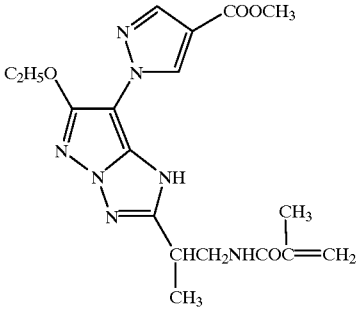
M-11
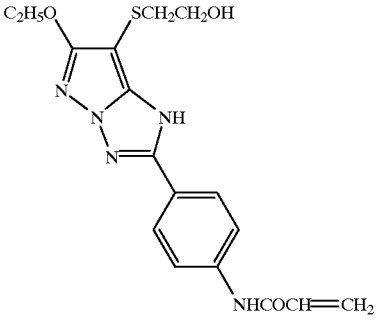

-continued
M-12
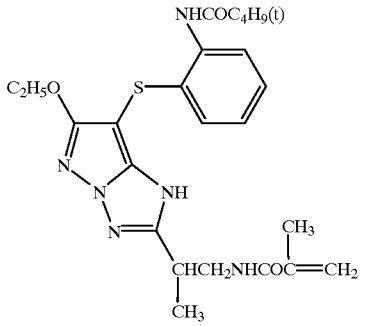
M-13
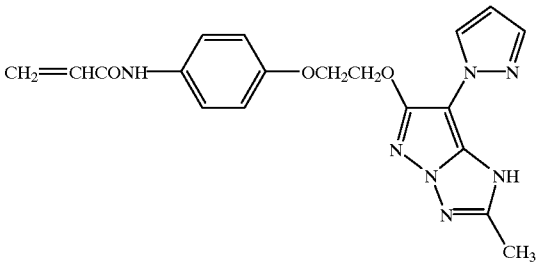
M-14
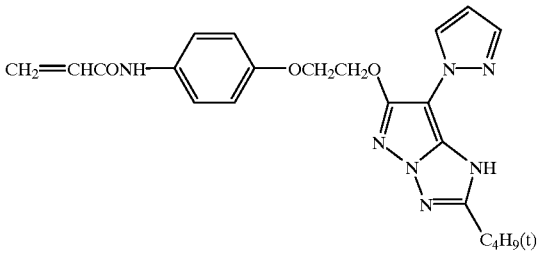
M-15
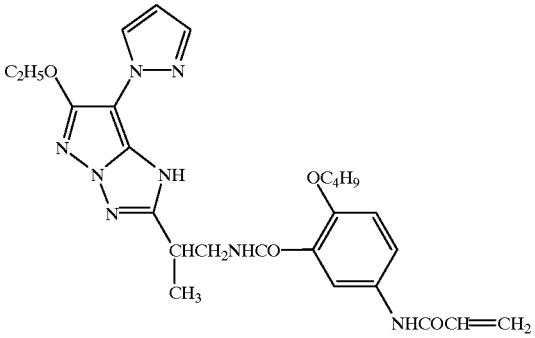
M-16
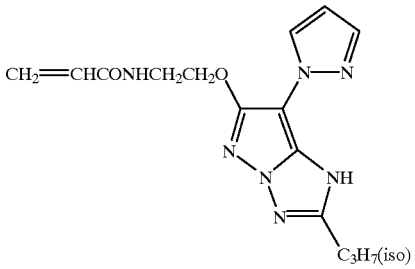
-continued
M-17
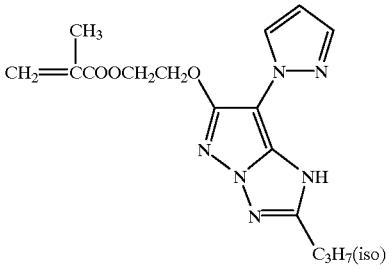
M-18
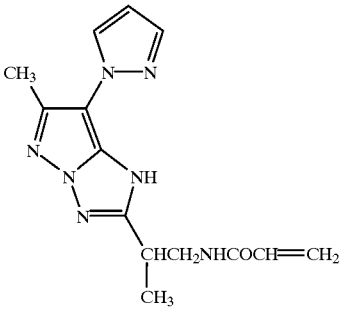
M-19
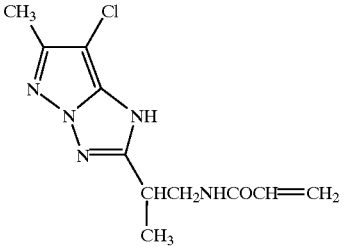
M-20
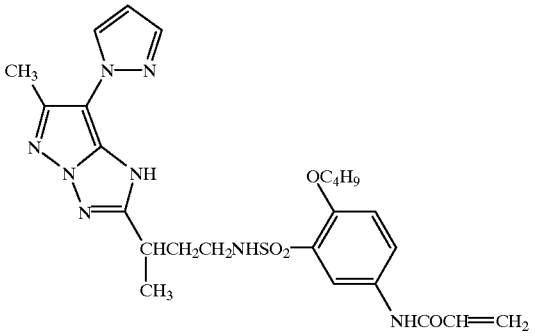

-continued
M-21
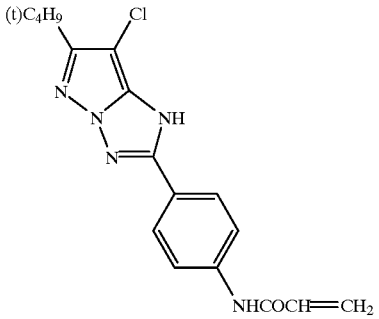
M-22
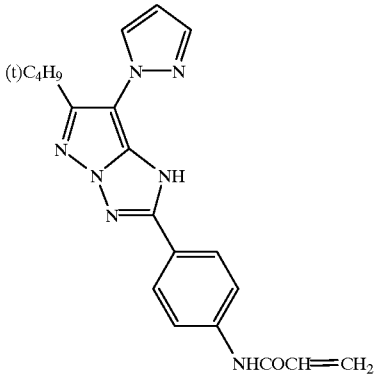
M-23
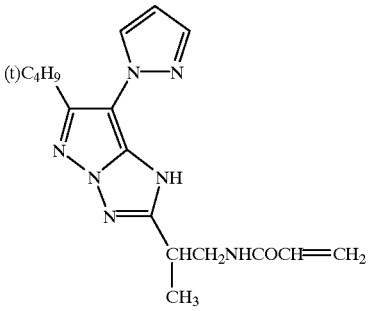
M-24
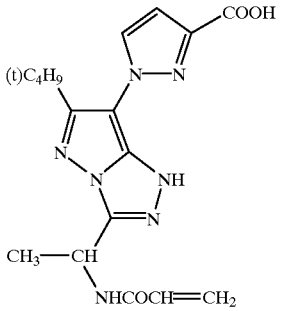
-continued
M-25
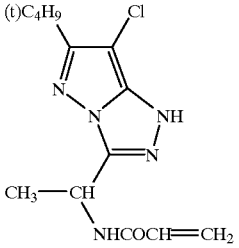
M-26
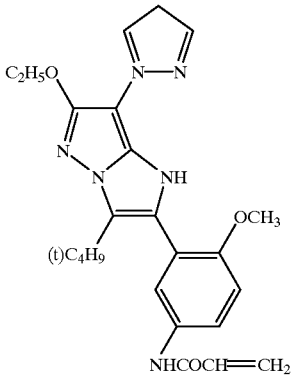
M-26
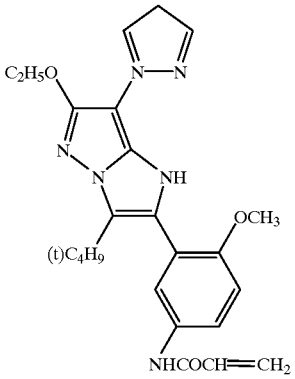
M-27
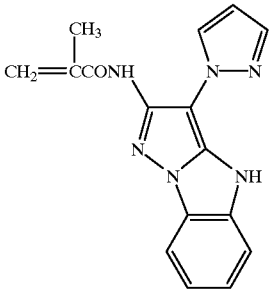

-continued

M-28

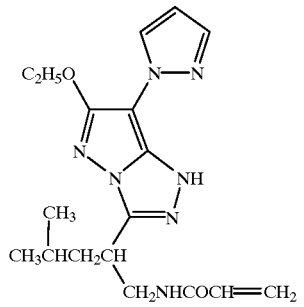

M-29

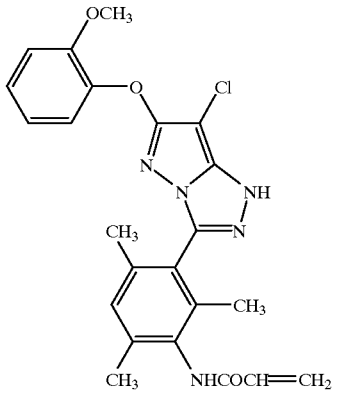

Suitable examples of the non-color-forming ethylenic monomer incapable of coupling with an oxidized product of an aromatic amine include acrylic acid, α-chloroacrylic acid, α-alkylacrylic acids (e.g., methacrylic acid) and esters and amides derived from these acrylic acids (e.g., acrylamide, methacrylamide, t-butylacrylamide, 2-acrylamido-2-methylpropanesulfonic acid, methyl acrylate, methyl methacrylate, ethyl acrylate, n-propyl acrylate, isopropyl acrylate, n-butyl acrylate, t-butyl acrylate, n-butyl methacrylate, 2-ethylhexyl acrylate, n-hexyl acrylate, n-octyl acrylate, lauryl acrylate, acetoacetoxyethyl methacrylate, glycidyl methacrylate, methylenebisacrylamide) vinyl esters (e.g., vinyl acetate, vinyl propionate, vinyl laurate), acrylonitrile, methacrylonitrile, aromatic vinyl compounds (e.g., styrene and derivatives thereof (e.g., potassium styrenesulfinate, sodium styrenesulfonate)), vinylidene chloride, vinyl alkyl ethers (e.g., vinyl ethyl ether), maleic acid esters, N-vinyl-2-pyrrolidone, N-vinylpyridine, and 2- and 4-vinylpyridines. In particular, acrylic acid esters, methacrylic acid esters, acrylamides, methacrylamides, styrene and styrene derivatives are preferred.

The polymer coupler for use in the present invention may be soluble or insoluble in water.

The polymer couplers for use in the invention may be prepared by once isolating a lipophilic polymer coupler or telomer coupler obtained by polymerization of coupler monomers, dissolving the coupler in an organic solvent, and emulsifying the coupler solution in a silver halide emulsion. Alternatively, a polymer coupler latex as obtained by emulsion polymerization or a layered polymer coupler latex may be directly added to a silver halide emulsion in gelatin. It is also possible to dissolve an isolated hydrophilic polymer coupler in water or a mixed solvent of water and a water-miscible organic solvent and adding the coupler solution to a silver halide emulsion in gelatin.

The molar ratio of the yellow coupler monomer of formula (I) and the magenta coupler monomer of formula (II) generally ranges from 1:100 to 100:1, preferably 1:10 to 10:1, still preferably 1:5 to 5:1, while varying depending on the absorption coefficient, absorption wavelength, etc. or the dye derived from each coupler monomer.

The proportion of the chromophoric moiety in the polymer coupler is preferably 5 to 90% by weight. The range of 10 to 80% by weight is still preferred from the viewpoint of color reproducibility, color developability and dye stability. The range of 20 to 70% by weight is particularly preferred.

Synthesis methods of the polymer coupler are roughly divided into (i) emulsion polymerization which provides a polymer coupler latex, (ii) seed polymerization which provides a layered polymer coupler latex, and (iii) solution polymerization which provides a lipophilic polymer coupler, a telomer coupler and a hydrophilic polymer coupler. Details of the synthesis and the addition manner of the coupler to an emulsion are described in U.S. Pat. No. 4,080,211 (as for method (i)), JP-A-58-42044 (as for method (ii)), and U.S. Pat. No. 3,451,820, JP-A-62-276548 and JP-A-60-218646 (as for method (iii)).

Polymer coupler latices, layered polymer coupler latices, lipophilic polymer couplers and telomer couplers are preferred. Polymer coupler latices, layered polymer coupler latices and lipophilic polymer couplers are still preferred, with lipophilic polymer couplers being particularly preferred.

Compositions of the polymer couplers synthesized are shown in Tables 1 to 6. However, the invention should not be construed as being limited to these polymer couplers.

In the following tables, the following abbreviations are used for the names of non-color-forming monomers used:

"MA" is an abbreviation for "methylmethacrylate";
"ER" for "ethylacrylate";
"BA" for "butylacrylate";
"2-EHA" for "2-ethylhexylacrylate";
"MAA" for "methacrylic acid";
"St" for "styrene";
"AAEMA" for "acetoacetoxyethylmethacrylate";
"AMPSN" for "sodium 2-acrylamido-2-methylpropanesulfonate";
"APSN" for "sodium 3-acryloyloxypropanesulfonate";
"GMA" for "glycidylmethacrylate";
"HMDAA" for "hydroxymethyldiacetoacrylamide";
"SSK" for "potassium styrenesulfinate"; and
"SSN" for "sodium styrenesulfinate".

TABLE 1

Oleophilic Polymer Couplers

| Oleophilic polymer coupler | Yellow Coupler Monomer Compound code | Yellow Coupler Monomer Amount used (g) | Magenta Coupler Monomer Compound code | Magenta Coupler Monomer Amount used (g) | Non-color-forming monomer Name abbreviated | Non-color-forming monomer Amount used (g) |
|---|---|---|---|---|---|---|
| P-1 | Y-1 | 39.2 | M-1 | 10.0 | BA | 49.2 |
| P-2 | Y-1 | 36.2 | M-1 | 10.0 | BA | 36.0 |
| P-3 | Y-1 | 22.9 | M-1 | 10.0 | BA | 32.9 |
| P-4 | Y-1 | 49.8 | M-2 | 10.0 | BA | 49.8 |
| P-5 | Y-1 | 37.7 | M-3 | 10.0 | BA | 37.7 |
| P-6 | Y-1 | 47.5 | M-5 | 10.0 | BA | 57.5 |
| P-7 | Y-1 | 44.6 | M-6 | 10.0 | BA | 43.7 |
| P-8 | Y-1 | 35.5 | M-10 | 10.0 | BA | 45.5 |
| P-9 | Y-2 | 35.7 | M-1 | 10.0 | BA | 45.7 |
| P-10 | Y-2 | 39.8 | M-2 | 10.0 | BA | 20.0 |
| P-11 | Y-2 | 41.2 | M-3 | 10.0 | BA | 41.2 |
| P-12 | Y-3 | 29.3 | M-1 | 10.0 | BA | 39.3 |
| P-13 | Y-3 | 37.1 | M-2 | 10.0 | BA | 47.1 |
| P-14 | Y-3 | 33.8 | M-3 | 10.0 | BA | 33.8 |
| P-15 | Y-3 | 33.8 | M-4 | 10.0 | BA | 33.8 |
| P-16 | Y-3 | 38.7 | M-5 | 10.0 | BA | 48.7 |
| P-17 | Y-3 | 31.0 | M-11 | 10.0 | EA | 42.0 |
| P-18 | Y-3 | 35.2 | M-16 | 10.0 | MA | 45.2 |
| P-19 | Y-4 | 40.0 | M-2 | 10.0 | BA | 50.0 |
| P-20 | Y-4 | 40.0 | M-2 | 10.0 | BA | 25.0 |
| P-21 | Y-4 | 33.4 | M-3 | 10.0 | BA | 43.4 |
| P-22 | Y-4 | 33.4 | M-4 | 10.0 | BA | 43.4 |
| P-23 | Y-5 | 38.2 | M-1 | 10.0 | BA | 48.2 |
| P-24 | Y-7 | 18.8 | M-1 | 10.0 | BA | 28.8 |
| P-25 | Y-7 | 37.2 | M-2 | 10.0 | BA | 47.2 |
| P-26 | Y-7 | 37.2 | M-2 | 10.0 | 2-EHA | 47.2 |
| P-27 | Y-7 | 24.0 | M-2 | 10.0 | BA | 34.0 |
| P-28 | Y-7 | 33.8 | M-3 | 10.0 | BA | 43.8 |
| P-29 | Y-7 | 33.8 | M-4 | 10.0 | BA | 43.8 |
| P-30 | Y-8 | 26.4 | M-2 | 10.0 | BA | 36.4 |
| P-31 | Y-8 | 21.5 | M-7 | 10.0 | BA | 31.5 |
| P-32 | Y-9 | 19.6 | M-21 | 10.0 | MA | 30.0 |
| | | | | | MAA | 5.0 |

TABLE 2

Oleophilic Polymer Couplers

| Oleophilic polymer coupler | Yellow Coupler Monomer Compound code | Yellow Coupler Monomer Amount used (g) | Magenta Coupler Monomer Compound code | Magenta Coupler Monomer Amount used (g) | Non-color-forming monomer Name abbreviated | Non-color-forming monomer Amount used (g) |
|---|---|---|---|---|---|---|
| P-33 | Y-11 | 39.7 | M-2 | 10.0 | BA | 24.8 |
| P-34 | Y-11 | 25.4 | M-22 | 10.0 | MAA | 3.5 |
| | | | | | MAA | 35.4 |
| P-35 | Y-14 | 40.4 | M-2 | 10.0 | BA | 40.3 |
| P-36 | Y-15 | 38.7 | M-2 | 10.0 | BA | 40.0 |
| P-37 | Y-18 | 38.3 | M-2 | 10.0 | BA | 40.0 |
| P-38 | Y-19 | 25.9 | M-1 | 10.0 | BA | 35.9 |
| P-39 | Y-19 | 31.5 | M-2 | 10.0 | BA | 24.9 |
| P-40 | Y-20 | 36.7 | M-2 | 10.0 | BA | 37.3 |
| P-41 | Y-20 | 33.4 | M-3 | 10.0 | BA | 26.0 |
| P-42 | Y-22 | 27.7 | M-1 | 10.0 | BA | 37.7 |
| P-43 | Y-22 | 36.6 | M-2 | 10.0 | BA | 26.6 |
| P-44 | Y-23 | 37.8 | M-2 | 10.0 | BA | 37.2 |
| P-45 | Y-23 | 31.7 | M-4 | 10.0 | BA | 31.7 |
| P-46 | Y-23 | 32.4 | M-9 | 10.0 | BA | 32.4 |
| P-47 | Y-26 | 32.8 | M-2 | 10.0 | BA | 42.8 |
| P-48 | Y-32 | 26.7 | M-4 | 10.0 | BA | 36.7 |
| p-49 | Y-38 | 40.0 | M-2 | 10.0 | BA | 40.0 |
| P-50 | Y-39 | 42.4 | M-2 | 10.0 | BA | 42.4 |
| P-51 | Y-3 | 18.9 | M-2 | 10.0 | BA | 47.6 |
| | Y-4 | 18.7 | | | | |
| P-52 | Y-4 | 45.8 | M-2 | 10.3 | BA | 45.8 |
| | | | M-11 | 3.7 | | |
| P-53 | Y-3 | 25.9 | M-2 | 10.3 | BA | 55.5 |
| | Y-23 | 29.3 | M-11 | 3.7 | | |
| P-54 | Y-3 | 26.6 | M-25 | 10.0 | BA | 18.3 |

TABLE 2-continued

| Oleophilic Polymer Couplers | | | | | | |
|---|---|---|---|---|---|---|
| Oleophilic | Yellow Coupler Monomer | | Magenta Coupler Monomer | | Non-color-forming monomer | |
| polymer coupler | Compound code | Amount used (g) | Compound code | Amount used (g) | Name abbreviated | Amount used (g) |
| | | | | | MA | 18.3 |
| P-55 | Y-3 | 26.8 | M-12 | 10.0 | MA | 36.8 |
| P-56 | Y-3 | 37.1 | M-2 | 10.0 | — | |
| P-57 | Y-8 | 26.4 | M-2 | 10.0 | — | |

TABLE 3

| Polymer Coupler Latices | | | | | | |
|---|---|---|---|---|---|---|
| Polymer | Yellow Coupler Monomer | | Magenta Coupler Monomer | | Non-color-forming monomer | |
| coupler latex | Compound code | Amount used (g) | Compound code | Amount used (g) | Name abbreviated | Amount used (g) |
| P-58 | Y-1 | 39.2 | M-1 | 10.0 | BA | 49.2 |
| P-59 | Y-2 | 39.9 | M-2 | 10.0 | BA | 39.8 |
| | | | | | MA | 10.0 |
| P-60 | Y-3 | 33.8 | M-3 | 10.0 | 2-EHA | 43.8 |
| P-61 | Y-3 | 38.7 | M-5 | 10.0 | BA | 48.7 |
| P-62 | Y-3 | 31.0 | M-11 | 10.0 | BA | 41.0 |
| P-63 | Y-3 | 35.2 | M-16 | 10.0 | BA | |
| P-64 | Y-4 | 33.4 | M-4 | 10.0 | BA | 38.4 |
| | | | | | St | 5.0 |
| P-65 | Y-5 | 38.2 | M-1 | 10.0 | BA | 48.2 |
| P-66 | Y-7 | 33.8 | M-3 | 10.0 | BA | 43.8 |
| P-67 | Y-8 | 21.5 | M-7 | 10.0 | BA | 31.5 |
| P-68 | Y-9 | 19.6 | M-21 | 10.0 | EA | 30.0 |
| P-69 | Y-11 | 25.4 | M-22 | 10.0 | MA | 35.4 |
| P-70 | Y-20 | 36.7 | M-2 | 10.0 | BA | 46.7 |
| P-71 | Y-23 | 32.4 | M-9 | 10.0 | BA | 42.8 |
| P-72 | Y-4 | 45.8 | M-2 | 10.3 | BA | 45.8 |
| | | | M-11 | 3.7 | | |

TABLE 4

| Telomer Couplers | | | | | | | | |
|---|---|---|---|---|---|---|---|---|
| | Chain Transfer Agent | | Yellow Coupler Monomer | | Magenta Coupler Monomer | | Non-color-forming Monomer | |
| Telomer coupler | Compound | Amount used (g) | Compound code | Amount used (g) | Compound code | Amount used (g) | Name abbreviated | Amount used (g) |
| P-73 | $C_{12}H_{25}SH$ | 8.0 | Y-1 | 39.7 | M-1 | 10.0 | BA | 25.0 |
| P-74 | $C_{12}H_{25}SH$ | 8.0 | Y-1 | 49.8 | M-2 | 10.0 | BA | 30.0 |
| P-75 | $C_{14}H_{29}SH$ | 8.0 | Y-1 | 37.7 | M-3 | 10.0 | BA | 25.0 |
| P-76 | $C_{12}H_{25}SH$ | 8.0 | Y-1 | 47.5 | M-5 | 10.0 | BA | 25.0 |
| P-77 | $C_{12}H_{25}SH$ | 8.0 | Y-1 | 44.6 | M-6 | 10.0 | BA | 23.0 |
| P-78 | $C_{12}H_{25}SH$ | 10.0 | Y-1 | 35.5 | M-10 | 10.0 | BA | 35.0 |
| P-79 | $C_{14}H_{29}SH$ | 10.0 | Y-2 | 35.7 | M-1 | 10.0 | BA | 22.5 |
| P-80 | $C_{12}H_{25}SH$ | 10.0 | Y-2 | 29.6 | M-2 | 10.0 | BA | 20.0 |
| P-81 | $C_{12}H_{25}SH$ | 10.0 | Y-2 | 41.2 | M-3 | 10.0 | BA | 25.0 |
| P-82 | $C_{12}H_{25}SH$ | 10.0 | Y-3 | 29.3 | M-1 | 10.0 | BA | 20.0 |
| P-83 | $C_{12}H_{25}SH$ | 10.0 | Y-3 | 37.1 | M-2 | 10.0 | BA | 25.0 |
| P-84 | $C_{12}H_{25}SH$ | 10.0 | Y-3 | 33.8 | M-3 | 10.0 | BA | 22.0 |
| P-85 | $C_{12}H_{25}SH$ | 10.0 | Y-7 | 19.9 | M-1 | 10.0 | BA | 20.0 |
| P-86 | $C_{14}H_{29}SH$ | 10.0 | Y-7 | 33.8 | M-4 | 10.0 | BA | 22.0 |

TABLE 5

Layer-Structure Polymer Coupler Latices

| Layer-structure Polymer | Seed Monomer | | Coupler Monomers added afterward: Yellow Coupler Monomer | | Coupler Monomers added afterward: Magenta Coupler Monomer | | Non-color-forming Monomer added afterward | |
|---|---|---|---|---|---|---|---|---|
| Coupler Latex | Name abbreviated | Amount used (g) | Compound code | Amount used (g) | Compound code | Amount used (g) | Name abbreviated | Amount used (g) |
| P-87 | BA | 10 | Y-1 | 35.2 | M-1 | 10.0 | BA | 30 |
| P-88 | EA | 10 | Y-2 | 39.8 | M-2 | 10.0 | EA | 30 |
| P-89 | BA | 5 | Y-3 | 29.3 | M-1 | 10.0 | BA | 30 |
| P-90 | BA | 10 | Y-3 | 37.1 | M-2 | 10.0 | BA | 30 |
| P-91 | BA | 10 | Y-3 | 38.8 | M-3 | 10.0 | BA | 20 |
| P-92 | BA | 10 | Y-3 | 33.8 | M-4 | 10.0 | BA | 25 |
| P-93 | BA | 10 | Y-3 | 38.7 | M-5 | 10.0 | BA | 35 |
| P-94 | MA | 5 | Y-3 | 30.2 | M-16 | 10.0 | BA | 20 |
| P-95 | BA | 10 | Y-7 | 33.8 | M-3 | 10.0 | BA | 20 |
| P-96 | BA | 5 | Y-19 | 28.0 | M-3 | 10.0 | BA | 25 |
| P-97 | BA | 5 | Y-23 | 37.8 | M-2 | 10.0 | BA | 30 |
| P-98 | BA | 5 | Y-24 | 35.7 | M-3 | 10.0 | BA | 20 |

TABLE 6

Hydrophilic Polymer Couplers

| Hydrophilic polymer coupler | Yellow Coupler Monomer: Compound code | Amount used (g) | Magenta Coupler Monomer: Compound code | Amount used (g) | Non-color-forming monomer: Name abbreviated | Amount used (g) |
|---|---|---|---|---|---|---|
| P-99 | Y-1 | 39.2 | M-1 | 10.0 | AMPSN | 45.0 |
| | | | | | SSK | 2.0 |
| P-100 | Y-1 | 49.8 | M-2 | 10.0 | HMDAA | 49.8 |
| P-101 | Y-2 | 33.8 | M-3 | 10.0 | AAEMA | 43.8 |
| P-102 | Y-3 | 37.1 | M-2 | 10.0 | AAEMA | 50.0 |
| | | | | | GMA | 5.0 |
| P-103 | Y-4 | 33.4 | M-4 | 10.0 | SSN | 40.0 |
| | | | | | AAEMA | 3.5 |
| P-104 | Y-7 | 24.0 | M-2 | 10.0 | HMDAA | 30.0 |
| | | | | | SSK | 4.0 |

Specific synthesis examples of the coupler monomer and the polymer coupler of the present invention are described below. However, the invention should not be construed as being limited to those examples.

Synthesis of Yellow Coupler Monomer (Y-1) Exemplified Above Synthesis Scheme (A)

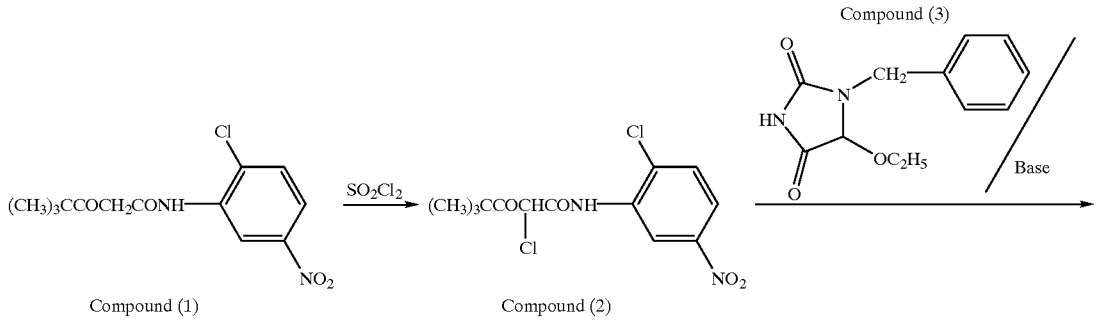

-continued

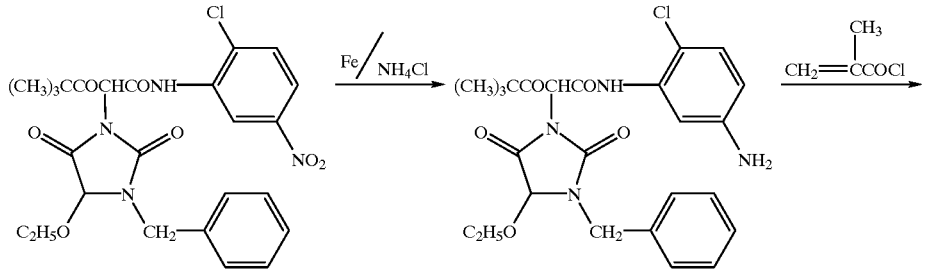

Compound (4) Compound (5)

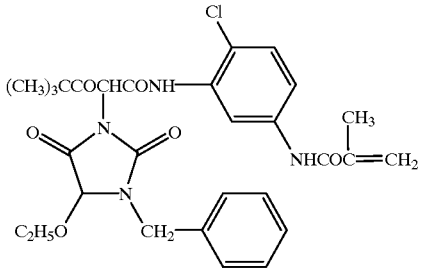

Yellow Coupler Monomer (Y-1)

Synthesis of Compound (4):

A four equivalent coupler (298.5 g (1.0 mol) of Compound (1)) was admixed with 1,000 ml of methylene chloride, and stirred at 10° C. Into this solution was dripped 88.7 g (1.1 mol) of sulfuryl chloride, followed by one-hour stirring at room temperature. Thereafter, the methylene chloride was distilled away under reduced pressure. Thereupon, Compound (2) precipitated as crystals. 585 g (2.5 mol) of Benzylethoxyhydantoin (Compound (3)) and 150 ml of dimethylformamide were added to those crystals, and stirred at room temperature. To the resulting solution, 345 ml (2.5 mol) of triethylamine was added, and heated at 40° C. for 3 hours with stirring to complete the reaction. At the completion of the reaction, the reaction mixture was rendered wealky acidic by the addition of hydrochloric acid, and extracted with ethyl acetate. Thus obtained ethyl acetate solution was washed with water, and dried over anhydrous magnesium sulfate. Then, the ethyl acetate was distilled away under reduced pressure. The residue was purified by column chromatography on silica gel (eluent: chloroform/ethyl acetate mixed solvent) to yield 467.3 g (88.0%) of Compound (4).

Synthesis of Compound (5):

Reduced iron in an amount of 300 g and ammonium chloride in an amount of 30 g were admixed with 300 ml of water and 3,000 ml of isopropanol, and heated with stirring. To this solution, the Compound (4) synthesized in the above described manner was added in an amount of some gram each for several times so that the total addition amount came to 425 g (0.8 mol). Then, the resulting admixture was stirred for 3 hours under heating. After the completion of the reaction, the insoluble matter was removed by hot filtration under reduced pressure. The resulting filtrate was admixed with water to liberate an oily matter. Thereto, ethyl acetate was added for extraction. The resulting ethyl acetate solution was washed with water, and dried over anhydrous sodium sulfate. Therefrom, ethyl acetate was removed by distillation under reduced pressure. Thus, 386.4 g (96.4%) of Compound (5) was obtained.

Synthesis of Yellow Coupler Monomer (Y-1):

Dimethylacetamide in a volume of 200 ml was added to 50 g (0.1 mol) of the amine form obtained in the above described manner (Compound (5)) and 0.5 ml of nitrobenzene, and stirred under cooling at a temperature of from 5 to 10° C. Thereinto, 11 g (0.105 mol) of methacrylic acid chloride was dripped, and stirred for 2 hours at a temperature of from 5 to 10° C., thereby completing the reaction. At the completion of the reaction, the reaction solution was extracted by the addition of water and ethyl acetate. The thus obtained ethyl acetate solution was washed with water, dried over anhydrous sodium sulfate, and therefrom the ethyl acetate was removed by distillation under reduced pressure. The resulting residue was admixed with isopropanol to deposit crystals. These crystals were filtered off, dried, and then recrystallized from isopropanol. Thus, 41.8 g (73.5%) of the intended Yellow Coupler Monomer (Y-1) was obtained.

Synthesis of Yellow Coupler Monomer (Y-4) exemplified above Synthesis Scheme (B)

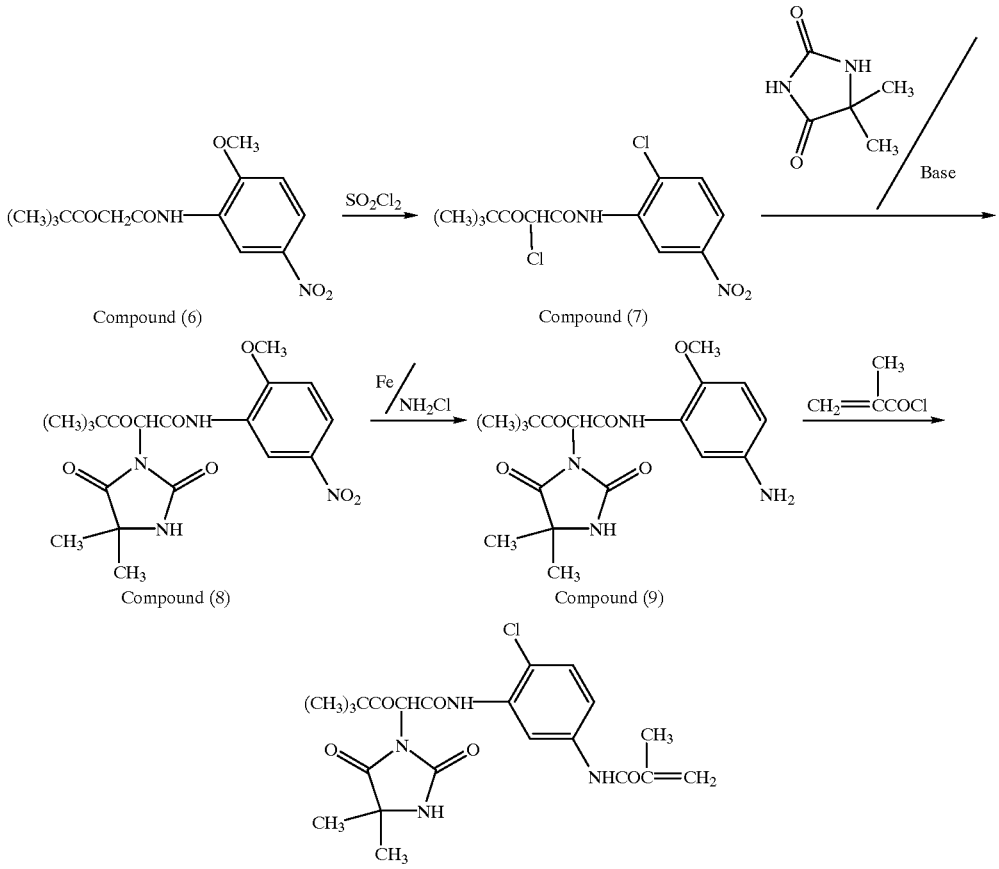

Synthesis of Compound (8):

A four equivalent coupler (Compound (6)) in an amount of 200 g (0.68 mol) was admixed with 1,000 ml of ethyl acetate, and stirred at from 10 to 15° C. Into this solution was dripped 57.5 ml (0.71 mol) of sulfuryl chloride, followed by one-hour stirring at room temperature. Thereafter, the ethyl acetate was distilled away under reduced pressure. Thereupon, Compound (7) precipitated as crystals. These crystals were dissolved in 300 ml of dimethylformamide.

Dimethylformamide in a volume of 500 ml was added to 218 g (1.7 mol) of dimethylhydantoin, cooled to 10° C. and stirred. Thereto, 350 ml of a 28% methanol solution of sodium methoxide (SM-28) was added, and further the above described dimethylformamide solution of Compound (7) was added dropwise. At the completion of the dropwise addition, the resulting mixture was stirred at from 30 to 40° C. for 4 hours to complete the reaction. After the completion of the reaction, the reaction mixture was rendered weakly acidic by the addition of hydrochloric acid, and then water was dripped thereinto to deposit crystals. These crystals were filtered off, washed with a 1:1 mixture of water and methanol, and then dried. Thus, 284 g (99.3%) of Compound (8) was obtained.

Synthesis of Compound (9):

Reduced iron in an amount of 200 g and ammonium chloride in an amount of 20 g were admixed with 100 ml of water and 1,000 ml of isopropanol, and heated with stirring. To this solution, the Compound (8) synthesized in the above described manner was added in an amount of some gram each for several times so that the total amount added came to 284 g. Then, the resulting admixture was stirred for 3 hours under heating. After the completion of the reaction, the insoluble matter was removed by hot filtration under reduced pressure. The resulting filtrate was concentrated to about 50% under reduced pressure. The concentrated residue was admixed with water to deposit crystals. These crystals were filtered off, dried, and then recrystallized from acetonitrile. Thus, 232.6 g (88.2%) of Compound (9) was obtained.

Synthesis of Yellow Coupler Monomer (Y-4):

The Compound (9) obtained in the above described manner in an amount of 117.1 g (0.3 mol) was dissolved in 400 ml of dimethylacetamide, and stirred under cooling at a temperature of from 0 to 10° C. Thereinto, 33.0 g (0.315 mol) of methacrylic acid chloride was dripped, and then stirred for 2 hours at a temperature below 10° C. At the completion of the reaction, the resulting solution was admixed with 2000 ml of water to deposit crystals. These crystals were filtered off, washed with water, dried, and then recrystallized from ethyl acetate. Thus, 108.3 g (78.7%) of the intended Yellow Coupler Monomer (Y-4) was obtained.

Synthesis of Magenta Coupler Monomer (M-1) Exemplified Above Synthesis Scheme (C)

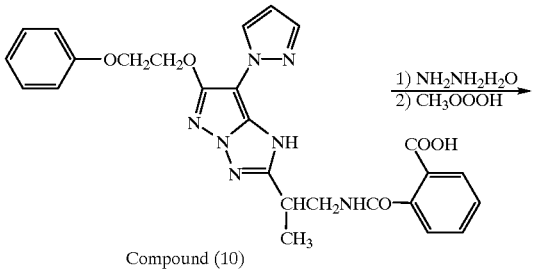

Compound (10)

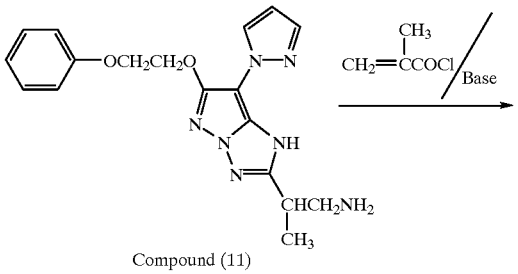

Compound (11)

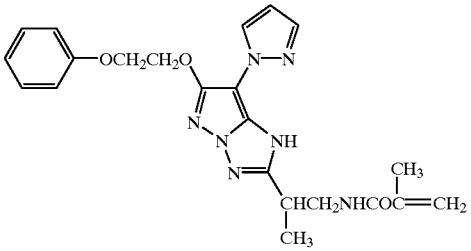

Magenta Coupler Monomer (M-1)

To 515.5 g (1.0 mol) of Compound (10), 1,250 ml of isopropanol was added, and stirred under heating. Thereto, 60 g of hydrazine monohydrate was added dropwise. The resulting mixture was stirred for 6 hours under heating to complete the reaction. Thereafter, the reaction solution was cooled to room temperature, and then admixed with 94 g of acetic acid and 1,000 ml of water. This solution was stirred for one hour at room temperature, and therefrom an insoluble matter was removed by filtration under reduced pressure. The filtrate was admixed with 2,000 ml of ethyl acetate, 2 ml of nitrobenzene and 420 g of sodium bicarbonate, and stirred at room temperature. Thereto, 110 g of methacrylic acid chloride was slowly added dropwise. At the completion of the addition, the mixture was stirred for 2 hours at room temperature to complete the reaction. Then, the water phase was removed, and the ethyl acetate solution remaining was washed with water and dried over anhydrous sodium sulfate. Further, the ethyl acetate was distilled away under reduced pressure. The residue was purified by column chromatography (eluent: n-hexane/ethyl acetate mixture), and crystallized from a 10:1 mixture of n-hexane and ethyl acetate. Thus, 275.5 g (63.3%) of the intended Monomer Coupler (M-1) was obtained.

Synthesis of Magenta Coupler Monomer (M-4) Exemplified Above Synthesis Scheme (D)

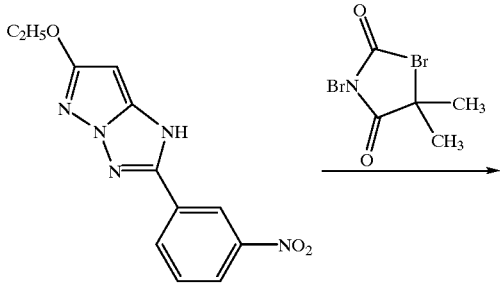

Compound (12)

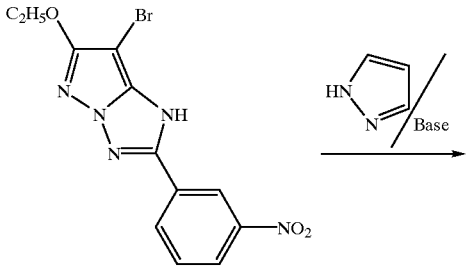

Compound (13)

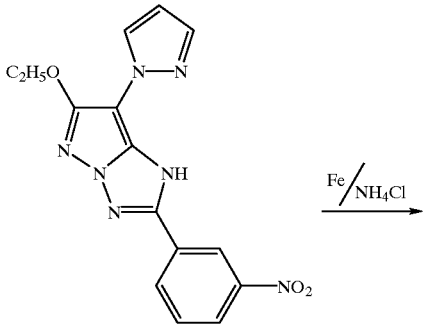

Compound (14)

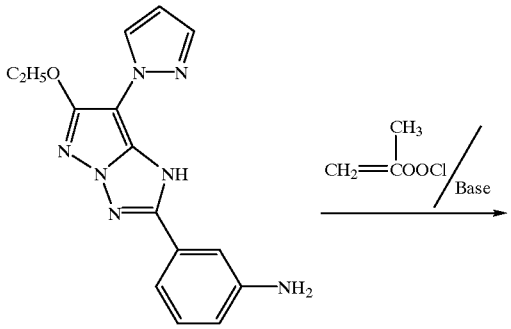

Compound (15)

-continued

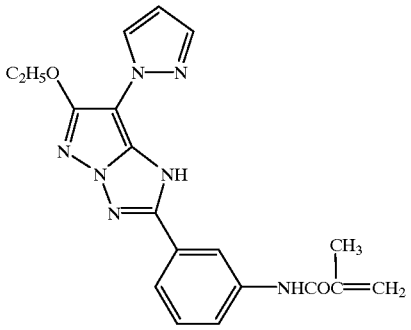

Magenta Coupler Monomer (M-4)

Synthesis of Compound (13):

A four equivalent coupler (Compound (12) in an amount of 136.6 g (0.5 mol) was admixed with 200 ml of dimethyl acetamide and 300 ml of ethyl acetate, and stirred at room temperature. To this solution, 1,3-dibromo-5,5-dimethylhydantoin was added in an amount of some gram each for several times so that the total amount added came to 75.1 g (0.26 mol), and stirred for 2 hours at room temperature. After the completion of the reaction, water was added thereto to precipitate crystals. These crystals were filtered off, and washed with water. Further, they were dispersed into acetonitrile, washed, filtered off, and then dried. Thus, Compound (13) was obtained in an amount of 132 g (74.9%).

Synthesis of Compound (14):

Sodium hydride (60% oil dispersion) in an amount of 32 g (0.8 mol) was dispersed into 350 ml of dimethyl acetamide, and stirred under cooling to below 10° C. Thereto, 48 g (0.7 mol) of pyrazole was added slowly. At the completion of the addition, the resulting mixture was stirred for one hour at room temperature, and thereto was added 73 g (0.2 mol) of Compound (13) obtained in the above described manner. The resulting solution was heated up to 120–130° C., and stirred for 4 hours. After the completion of the reaction, the reaction solution was cooled to room temperature, poured into water, rendered acidic with hydrochloric acid, and then extracted with ethyl acetate. The ethyl acetate solution thus obtained was washed with water, and dried over anhydrous magnesium sulfate. Therefrom, the ethyl acetate was removed by distillation under reduced pressure to cause the deposition of crystals. These crystals were dispersed into acetonitrile, filtered off, and then dried. Thus, Compound (14) was obtained in an amount of 45.5 g (67.0%).

Synthesis of Compound (15):

Reduced iron in an amount of 30 g and ammonium chloride in an amount of 3 g were admixed with 15 ml of water and 150 ml of isopropanol, and heated with stirring. To this solution, the Compound (14) synthesized in the above described manner was added in an amount of some gram each for several times so that the total amount added came to 33.9 g (0.1 mol). Then, the resulting admixture was stirred for 3 hours under heating. After the completion of the reaction, the insoluble matter was removed by hot filtration under reduced pressure. The resulting filtrate was concentrated to about 50% under reduced pressure. The concentrated residue was admixed with 5.6 ml of concentrated sulfuric acid to deposit crystals. These crystals were filtered off, and then dried. Thus, 32.4 g (79.5%) of the sulfate of Compound (15) was obtained.

Synthesis of Magenta Coupler Monomer (M-4):

Nitrobenzene in a volume of 0.5 ml and dimethyl acetamide in a volume of 56 ml were added to 14.7 g (0.036 mol) of the sulfate of Compound (15) obtained in the above described manner, and stirred at room temperature. To this solution, 3.9 g (0.037 mol) of methacrylic acid chloride was added dropwise. After one-hour stirring at room temperature, the reaction solution was poured into water, and extracted with ethyl acetate. The ethyl acetate solution obtained was washed with water, and then dried over anhydrous magnesium sulfate. Therefrom, the ethyl acetate was removed by distillation under reduced pressure. The residue was admixed with n-hexane and ethyl acetate to precipitate crystals. These crystals were purified by filtration, drying and subsequent recrystallization from a mixture of n-hexane and ethyl acetate. Thus, 9.4 g (69.0%) of the intended Coupler Monomer (M-4) was obtained.

Synthesis of Polymer Coupler (P-1) Exemplified Above

Dimethyl acetamide in a volume of 500 ml was added to 39.2 g of Yellow Coupler Monomer (Y-1), 10.0 g of Magenta Coupler Monomer (M-1) and 49.2 g of butyl acrylate (abbreviated as "BA"), and stirred under heating at 80° C. in a stream of nitrogen. To this solution was added 0.8 g of dimethyl 2,2'-azobisisodimethyl butyrate (polymerization initiator). Then, the resulting solution was stirred for two hours under heating, and thereto 0.8 g of the polymerization initiator was added again. Further, the stirring under heating was continued for 2 hours, and then 0.8 g of the polymerization initiator was added. Furthermore, the solution was stirred for 4 hours under heating. The reaction solution thus obtained was cooled to room temperature, and admixed with water and ethyl acetate for extraction. The ethyl acetate solution obtained was washed with water, and dried over anhydrous sodium sulfate. Therefrom, the ethyl acetate was removed by distillation under reduced pressure. Thus, 97.3 g of the intended Polymer Coupler (P-1) was obtained.

Synthesis of Polymer Coupler (P-22) Exemplified Above:

Dimethyl acetamide in a volume of 500 ml was added to 33.4 g of Yellow Coupler Monomer (Y-4), 10.0 g of Magenta Coupler Monomer (M-4) and 49.4 g of butyl acrylate (abbreviated as "BA"), and stirred under heating at 80° C. in a stream of nitrogen. To this solution was added 0.8 g of the polymerization initiator. Then, the resulting solution was stirred for two hours under heating, and thereto 0.8 g of the polymerization initiator. Then, the resulting solution was stirred for two hours under heating, and thereto 0.8 g of the polymerization initiator was added again. Further, the stirring under heating was continued for 2 hours, and then 0.8 g of the polymerization initiator was added. Furthermore, the solution was stirred for 4 hours under heating. The reaction solution thus obtained was cooled to room temperature, and admixed with water and ethyl acetate for extraction. The ethyl acetate solution obtained was washed with water, and dried over anhydrous sodium sulfate. Therefrom, the ethyl acetate was removed by distillation under reduced pressure. Thus, 85.1 g of the intended Polymer Coupler (P-22) was obtained.

The polymer coupler latices exemplified above were synthesized according to the method described in U.S. Pat. No. 4,080,211. The layered polymer coupler latices exemplified above were synthesized according to the method described in JP-A-58-42044. Further, the oleophilic polymer couplers, the telomer couplers and the hydrophilic polymer couplers were synthesized according to the methods described in U.S. Pat. No. 3,451,820, JP-A-62-276548 and JP-A-60-218646.

Silver halide grains for use in the present invention can be silver chloride grains, silver iodochloride grains, silver chlorobromide grains or silver iodochlorobromide grains. The silver halide grains preferably have a chloride content of at least 50 mol %, more preferably at least 80 mol %, and preferably have an iodide content of not more than 2 mol %. more preferably not more than 1 mol %, particularly preferably not more than 0.5 mol %.

The silver halide emulsion for use in the present invention may be those of surface latent image type or those of internal latent image type. The emulsions of the internal latent image type are combined with a nucleating agent or fogging with light, and thereby they are used as a direct reversal emulsion. The crystal structure of emulsion grains may be a uniform structure or a multilayer structure having a different halide composition between the core part and the core-surrounding part. Further, the emulsion grains used may have in their crystal structure an epitaxial junction formed by the fusion of silver halide phases different in halide composition, or by the fusion of a silver halide phase and a different compound phase, e.g., a silver thiocyanate phase, a zinc oxide phase or so on.

As for the high chloride content emulsions which are preferably used in the present invention, the emulsion grains therein can have a structure such that silver bromide-localized phases are present inside and/or the surface of the grains in a layered or non-layered form. In such a localized phase, the bromide content is preferably at least 20 mol %, and more preferably more than 30 mol %. The bromide content in a silver bromide-localized phase can be determined by X-ray diffractiometry or the like. For example, C. R. Berry & S. J. Marino describe the application of X-ray diffractiometry to silver halide grains in *Photographic Science and Technology*, volume 2, page 149 (1955) and ibid., volume 4, page 22 (1957). The bromide-localized phases can be present inside the grains, or at the edges, corners or faces of the grain surface. In particular, it is preferable for those phases to be present at the corners of the grain surface in a condition of epitaxial junction.

To ensure a large specific surface area and a high development activity in spite of the greatest possible reduction of the silver amount used, the silver halide grains preferably have an average grain diameter ranging from 0.05 to 0.9 $\mu$m, more preferably from 0.1 to 0.5 $\mu$m. In the case of tabular grains, the thickness thereof is preferably from 0.05 to 0.9 $\mu$m, and particularly preferably from 0.1 to 0.5 $\mu$m.

The silver halide emulsion for use in the present invention may be monodisperse emulsion which are narrow in grain size distribution. The term "monodisperse emulsion" as used herein means, e.g., a silver halide emulsion having a grain size distribution such that at least 80% of the emulsion grain have their grain size within the range of ±30% of its number or weight average grain size. In other words, the emulsion for use in the present invention may be monodisperse silver halide emulsion having a variation coefficient of not more than 20%, especially not more than 15% with respect to grain size distribution.

Alternatively, multidisperse emulsions having a wide grain size distribution may also be used.

The silver halide emulsion for use in the present invention can be prepared using the method described in *Research Disclosure* (abbreviated as "RD", hereinafter), Vol. 176, No. 17643, pp. 22–23, entitled "I. Emulsion preparation and types" (December, 1978), and RD, No. 18716, p. 648 (November, 1979); P. Glafkides, *Chemie et Phisique Photographique*, Paul Montel (1967); G. F. Duffin, *Photographic Emulsion Chemistry*, Focal Press (1966); V. L. Zelikman et al., *Making and Coating Photographic Emulsion*, Focal Press (964); and so on.

Monodisperse emulsions described in U.S. Pat. Nos. 3,574,638 and 3,655,394, British Patent 1,413,748, etc. are also preferably used.

Further, tabular emulsion grains having an aspect ratio not less than about 5 can be used in the present invention. Such tabular grains can be easily prepared using the method described in Gutoff, *Photographic Science and Engineering*, volume 14, pages 248–257 (1970), U.S. Pat. Nos. 4,434,226, 4,414,310, 4,433,048 and 4,439,520, and British Patent 2,112,157, etc. Also, a mixture of grains having various crystal forms may be used.

The photosensitive silver halide emulsion for use in the present invention are generally chemically sensitized. As the chemical sensitization, known chemical sensitization processes for emulsions of common photosensitive materials, such as a chalcogen sensitization process including a sulfur sensitization process, a selenium sensitization process and tellurium sensitization process, a noble metal sensitization process using gold, platinum, palladium or the like, and a reduction sensitization process, can be employed alone or in combination of two or more thereof, as described, e.g., in JP-A-03-110555 and JP-A-05-241267. Such chemical sensitization can be also carried out in the presence of a nitrogen-containing heterocyclic compound, as described in JP-A-62-253159. Further, an antifoggant described below can be added after completion of the chemical sensitization. Specifically, the addition of an antifoggant can be performed in the ways as described in JP-A-05-45833 and JP-A-62-40446.

The pH during the chemical sensitization is preferably from 5.3 to 10.5, and more preferably from 5.5 to 8.5; while the pAg is preferably from 6.0 to 10.5, and more preferably from 6.8 to 9.0.

The coating amount of photosensitive silver halide emulsion for use in the present invention is from 1 mg/m$^2$ to 10 g/m$^2$ in terms of silver.

To impart color sensitivities including green sensitivity, red sensitivity and infrared sensitivity to the photosensitive silver halide for use in the present invention, the photosensitive silver halide emulsion are spectrally sensitized with methine dyes or other dyes. Further, a photosensitive silver halide emulsion may be spectrally sensitized in a blue region to be rendered blue-sensitive, if needed.

The dyes used for the above described purpose include cyanine dyes, merocyanine dyes, complex cyanine dyes, complex merocyanine dyes, holopolar cyanine dyes, hemicyanine dyes, styryl dyes and hemioxonol dyes.

Specific examples of such dyes are the spectral sensitizing dyes recited in U.S. Pat. No. 4,617,257, JP-A-59-180550, JP-A-64-13546, JP-A-05-45828, JP-A-05-45834, etc.

These sensitizing dyes may be employed individually or in combination of two or more thereof. In particular, combinations of sensitizing dyes are often used for supersensitizing or for adjusting the intended spectral sensitization wavelengths.

Dyes which themselves do not spectrally sensitize silver halide emulsions, or compounds which do not substantially absorb light in the visible region, but which each exhibits a supersensitizing effect may be incorporated into silver halide emulsions in combination with the sensitizing dye, as described, e.g., in U.S. Pat. No. 3,615,641 and JP-A-63-23145.

These sensitizing dyes may be added to silver halide emulsion either during, before or after the chemical ripening or, as described in U.S. Pat. Nos. 4,183,756 and 4,225,666, either before or after the nucleation of silver halide grains. Additionally, those sensitizing dyes and supersensitizers may be added in the form of solution dissolved in an organic solvent such as methanol, in the form of dispersion in gelatin, or in the form of solution comprising a surfactant. The addition amount of the sensitizing dyes or supersensitizers is generally about $10^{-8}$ to $10^{-2}$ mol per mole of silver halide.

Additives used during the above described steps and known photographic additives which can be used in the present invention are described in the above-cited RD No. 17643, RD No. 18716 and RD No. 307105. The following is a list of those additives and the locations of their descriptions in the above-cited references.

| Additives | RD 17643 | RD 18716 | RD 307105 |
|---|---|---|---|
| 1. Chemical Sensitizer | p. 23 | p. 648, right column | p. 866 |
| 2. Sensitivity Rising Agent | | p. 648, right column | |
| 3. Spectral Sensitizer, and Supersensitizing Agent | pp. 23–24 | p. 648, right column, to p. 649, right column | pp. 866–868 |
| 4. Brightening Agent | p. 24 | p. 648, right column | p. 868 |
| 5. Antifoggant and Stabilizer | pp. 24–25 | p. 649, right column | pp. 868–870 |
| 6. Light Absorbent, Filter Dye, and UV Absorbent | pp. 25–26 | p. 649, right column, to p. 650, left column | p. 873 |
| 7. Dye Image Stabilizer | p. 25 | p. 650, left column | p. 872 |
| 8. Hardener | p. 26 | p. 651, left column | pp. 874–875 |
| 9. Binder | p. 26 | p. 651, left column | pp. 873–874 |
| 10. Plasticizer, and Lubricant | p. 27 | p. 650, right column | p. 876 |
| 11. Coating Aid, and Surfactant | pp. 26–27 | p. 650, right column | pp. 875–876 |
| 12. Antistatic Agent | p. 27 | p. 650, right column | pp. 876–877 |

A color developing agent for use in the present invention only required to such that its oxidized product generated upon developing a silver halide can undergo a coupling reaction with a coupler to form a dye, and such a compound is well known in the photographic arts. Specific examples of the color developing agent is described, e.g., in T. H. James, *The Theory of the Photographic Process*, 4th ed., pp. 291–334. In particular, p-phenylenediamine derivatives are preferred as the color developing agent.

Known various color couplers can be used in combination with the above described couplers of the present invention, and specific examples of such color couplers are described in the patent gazettes cited in RD, No. 17643, VII–C to VII–G.

In the present invention, two equivalent color couplers having the coupling site thereof substituted with a dissociative group are preferable to four equivalent color couplers whose coupling site has a hydrogen atom for reducing the coating amount of silver.

Suitable yellow couplers which can be used in combination in the present invention typically include oil-protected type acylacetamide couplers, whose specific examples are given in U.S. Pat. Nos. 2,407,210, 2,875,057, and U.S. Pat. No. 3,265,506. Two equivalent yellow couplers, which are preferred as mentioned above, typically include yellow couplers of oxygen-release type as described in U.S. Pat. Nos. 3,408,194, 3,447,928, 3,935,501 and 4,022,620; and nitrogen-release type yellow couplers as described in JP-B-58-10739, U.S. Pat. Nos. 4,401,752 and 4,326,024, RD, 18053 (April, 1979), British Patent 1,425,020, and West German Patent OLS Nos. 2,219,917, 2,261,361, 2,329,587, and 2,433,812. In particular, α-pivaloylacetanilide couplers produce dyes having excellent fastness, especially to light, and α-benzoylacetanilide couplers produce dyes exhibiting high developed color density.

Suitable magenta couplers which can be used in combination in this invention include oil-protected couplers, and those of 5-pyrazolone type and those of pyrazoloazole type such as pyrazolotriazoles are preferred. Of the 5-pyrazolone type couplers, those substituted by an arylamino or acylamino group at the 3-position are preferred in view of hue and color density of the dye produced therefrom. Typical examples of such 5-pyrazolone couplers are described in U.S. Pat. Nos. 2,311,082, 2,343,703, 2,600,788, 2,908,573, 3,062,653, 3,152,896, and 3,936,015. Dissociative groups of two equivalent 5-pyrazolone couplers preferably include dissociative groups at the site of nitrogen atom as described in U.S. Pat. No. 4,310,619 and arylthio groups as described in U.S. Pat. No. 4,351,897. Further, 5-pyrazolone couplers having a ballast group as described in European Patent 73,636 provide a high color density.

Suitable pyrazoloazole couplers include pyrazoloabenzimidazoles as described in U.S. Pat. No. 3,369,879, preferably pyrazolo[5,1-c][1,2,4]triazoles as described in U.S. Pat. No. 3,725,067, pyrazolotetrazoles as described in RD 24220 (June, 1984), and pyrazolopyrazoles as described in RD 24230 (June, 1984). The imidazo[1,2-b]pyrazoles described in European Patent 119,741 are preferable, and the pyrazolo[1,5-b][1,2,4]triazole described in European Patent 119,860 is particularly preferable because they produce a dye exhibiting slight side absorption in the yellow region and having high fastness to light.

Cyan couplers which can be used in combination in the present invention include naphthol couplers described in U.S. Pat. Nos. 2,474,293, 4,052,212, 4,146,396, 4,228,233, and 4,296,200; phenol couplers having an alkyl group containing 2 or more carbon atoms at the m-position of the phenol nucleus described in U.S. Pat. No. 3,772,002; 2,5-diacylamino-substituted phenol couplers described in U.S. Pat. Nos. 2,772,162, 3,758,308, 4,126,396, 4,334,011 and 4,327,173, West German Patent Publication OLS No. 3,329,729, and JP-B-3-18175; and phenol couplers having a phenylureido group at the 2-position and an acylamino group at the 5-position described in U.S. Pat. Nos. 3,446,622, 4,333,999, 4,451,559 and 4,427,767. Carbostyryl couplers described in JP-A-7-294714 are preferably used because of its excellent resistance to heat and light.

In addition to these couplers, the following various couplers can be used in the present invention.

Typical examples of polymerized dye-forming couplers are described in U.S. Pat. Nos. 3,451,820, 4,080,211 and 4,367,282, and British Patent 2,102,173.

Couplers capable of releasing a photographically useful residue upon coupling are also preferably used. Examples of suitable DIR couplers which release a development inhibitor are described in the patents cited in the above described RD No. 17643, items VII-F, JP-A-57-151944, JP-A-57-154234, JP-A-60-184248, and U.S. Pat. No. 4,248,962.

Examples of couplers which imagewise release a nucleating agent or a development accelerator at the time of development are described in British Patents 2,097,140 and 2,131,188, JP-A-59-157638 and JP-A-59-170840.

Other couplers which can also be used in the photosensitive material of the present invention include competing couplers described in U.S. Pat. No. 4,130,427; polyequivalent couplers described in U.S. Pat. Nos. 4,283,472, 4,338, 393 and 4,310,618; couplers capable of releasing a DIR redox compound described in JP-A-60-185950; and couplers capable of releasing a dye which restores its color after release described in EP-A-173,302.

The coupler for black color compensation includes those developing a yellow, magenta or cyan color, but those developing a brown, orange, purple or black color are also included as examples thereof.

The equivalent ratio of a silver halide to the polymer coupler of the present invention in each silver halide emulsion layer is from 0.5 to 100, preferably from 1 to 10, still preferably from 1 to 3. Particularly, the equivalent ratio is preferably from 1 to 2 in the case of using a silver halide emulsion having an average grain size (or a grain thickness for tabular grains) of not more than 0.9 $\mu$m, especially not more than 0.5 $\mu$m. The expression "equivalent ratio" as used herein has the following meaning: The theoretical amount of silver halide necessary for color-developing all the couplers present in an emulsion layer is defined as the case in which the equivalent ratio is 1. Accordingly, if the amount of silver halide coated is twice the theoretical amount, the value of 2 is given for the equivalent ratio. More specifically, when the coated silver amount is two mol per mol of a two equivalent coupler, the equivalent ratio is 1; while the equivalent ratio is 2 when the amount of coated silver is four mol per mol of a two equivalent coupler.

The above-recited couplers for use in combination in the present invention can be incorporated into a photosensitive material according to known various dispersion methods.

Examples of a high boiling solvent used in oil-in-water dispersion methods are described, e.g., in U.S. Pat. No. 2,322,027. The suitable amount of a high boiling solvent is generally not higher than 10 g, preferably not higher than 5 g, and more preferably from 1 g to 0.1 g, per gram of couplers. To 1 g of a binder, on the other hand, it is appropriate to use not more than 2 g, preferably not more than 1 g, particularly preferably not more than 0.5 g, of a high boiling solvent. The size of oil particles in a coupler dispersion (coupler emulsion) obtained by an oil-in-water dispersion method generally ranges from 0.05 $\mu$m to 0.9 $\mu$m, preferably 0.1 $\mu$m to 0.5 $\mu$m.

The processes and effects of a latex dispersion method as well as specific examples of a latex used for impregnation are described, e.g., in U.S. Pat. No. 4,199,363 and West German Patent Applications (OLS) 2,541,274 and 2,541, 230.

In coupler-containing layers of the photosensitive material of the present invention, it is desirable to use the compounds which improves color image stability as described in EP-A2-0277589. In particular, these compounds are preferably used in combination with pyrazoloazole type magenta couplers.

That is, compounds of the kind which produces chemically inert, substantially colorless compounds by reacting with an aromatic amine developing agent remaining after the color development-processing (Compound F) and/or compounds of the kind which produces chemically inert, substantially colorless compounds by reacting with an oxidized product of an aromatic amine developing agent remaining after the color development-processing (Compound G) are preferably used in combination or independently. By the use of these compounds, the generation of stains, which are due to the formation of coloring dyes through the reaction between the couplers and the unoxidized or oxidized color developing agent remaining in the processed photographic film, and the occurrence of other side reactions upon storage after photographic processing, can be inhibited effectively.

In silver halide emulsion layers, interlayers, etc. of the photosensitive material of the present invention, hydroquinone derivatives, aminophenol derivatives, gallic acid derivatives, ascorbic acid derivatives and the like may be contained as a color fog inhibitor or a color mixing inhibitor. Of these compounds, those which hardly generate stains even when they are heated up to 160–220° C. are preferred.

To prevent a cyan dye image from deteriorating due to heat and light, particularly light, it is more effective to incorporate an ultraviolet absorbent in the cyan color-forming layer and the layers provided on both upper and lower sides thereof.

Examples of the ultraviolet absorbent for use in the present invention include aryl-substituted benzotriazole compounds (e.g., those described in U.S. Pat. No. 3,533, 794), 4-thiazolidone compounds (e.g., those described in U.S. Pat. Nos. 3,314,794 and 3,352,681), benzophenone compounds (e.g., those described in JP-A-46-2784), cinnamate compounds (e.g., those described in U.S. Pat. Nos. 3,705,805 and 3,707,395), butadiene compounds (e.g., those described in U.S. Pat. No. 4,045,229), and benzoxazole compound (e.g., those described in U.S. Pat. Nos. 3,406,070 and 4,271,307). In addition, ultraviolet absorbing couplers (such as cyan dye-forming couplers of $\alpha$-naphthol type) and ultraviolet absorbing polymers may be used. These ultraviolet absorbents may be mordanted to a particular layer. Of these ultraviolet absorbents, the aryl-substituted benzotriazole compounds are preferred.

Further, the antimolds described in JP-A-63-271247 is preferably added to the photosensitive material of the present invention to prevent various kinds of molds and bacteria from propagating in hydrophilic colloid layers to thereby inhibit image deterioration.

Gelatin is advantageously used as a binder or a protective colloid in silver halide emulsion layers, intermediate layers and protective layers of the photosensitive material of the present invention. Other hydrophilic polymers may also be used as well. Examples of the hydrophilic polymer include polyvinyl alcohol, polyvinyl alcohol partial acetal, polyvinyl butyral, poly-N-vinylpyrrolidone, polyacrylic acid, polyacrylamide, polyvinylimidazole, polyvinylpyrazole, carrageenan, gum arabic, and homo- or co-polymers of cellulose derivatives, e.g., a hydroxyalkyl cellulose, carboxymethyl cellulose, cellulose sulfate, cellulose acetate hydrogen phthalate and sodium alginate.

Graft polymers of gelatin and other polymers are also useful. Examples of the gelatin graft polymer include gelatin having grafted thereto a homo- or co-polymer of vinyl monomers such as acrylic acid or methacrylic acid or a derivative thereof (e.g., a esters or amides), acrylonitrile, and styrene. Graft polymers of gelatin and polymers having compatibility with gelatin to some extent (such as a polymer of acrylic acid, methacrylic acid, acrylamide, methacrylamide or a hydroxyalkyl methacrylate) are preferred. Examples of these gelatin graft polymers are described in U.S. Pat. Nos. 2,763,625, 2,831,767 and 2,956,884 and JP-A-56-65133.

Typical synthetic hydrophilic polymers that are useful as binders are described in West German Patent (OLS) No. 2,312,708, U.S. Pat. Nos. 3,620,751 and 3,879,205, and JP-B-43-7561.

The above-described hydrophilic polymers can be used either individually or as a combination of two or more thereof.

Gelatin species which can be used include alkali-processed gelatin, acid-processed gelatin, enzyme-processed gelatin and mixtures thereof. Gelatin derivatives obtained by reacting gelatin with various compounds, such as acid halides, acid anhydrides, isocyanates, bromoacetic acid, alkane sultones, vinylsulfonamides, maleinimide compounds, polyalkylene oxides and epoxy compounds, are also useful. Examples of the gelatin derivative are given in U.S. Pat. Nos. 2,614,928, 3,132,945, 3,186,846 and 3,312,553, British Patents 861,414, 1,033,189, and 1,005,784, and JP-B-42-26845.

The total amount of the binder for use in the photosensitive material is preferably from 3 to 10 g/m$^2$. A binder content of each layer, e.g., a silver halide emulsion layer or an intermediate layer, is preferably from 0.1 to 1.5 g/m$^2$, particularly preferably from 0.2 to 1.0 g/m$^2$.

The support for use in the invention is preferably light-transmitting substrate. Where photosensitive emulsion layers are provided on a separate substrate (temporary support) and then transferred to adhere onto a light-transmitting substrate as described in JP-A-7-244212, the temporary support are not necessarily required to be light-transmitting For example, a substrate having a back layer comprising carbon black can be used. In this type of light-sensitive material, the amount of binders used in a peeling layer and/or the back layer is excluded from the "total amount of the binder" as referred to above.

Light-transmitting materials being optically isotropic and having excellent heat resistance, such as polyethylene terephthalate, polybutylene terephthalate, polyethylene naphthalate, polystyrene, polycarbonate, polyether sulfone, cellulose acetate, polyarylate, soda glass, borosilicate glass and quartz, are suitable as the light-transmitting substrate.

If desired, the surface of the substrate made of the above material may be coated with a subbing layer and may further be subjected to a surface treatment, such as a glow discharge treatment, a corona discharge treatment or ultraviolet irradiation.

The light-transmitting substrate can be used in the form of a plate, a sheet or a film. While arbitrarily selected according to the end use or the kind of the material, the thickness of the substrate generally ranges from 0.01 to 10 mm. For example, the thickness is within the range of from 0.3 to 3 mm in the case of glass substrate.

The polymer coupler of the present invention can be used in any layer of commonly used negative or positive color photographic materials which contain a yellow coupler in a blue-sensitive emulsion layer, a magenta coupler in a green-sensitive emulsion layer, and a cyan coupler in a red-sensitive emulsion layer. The polymer coupler of the invention can also be used in light-sensitive materials having the following constitutions (a) and (b).

Figure 2:
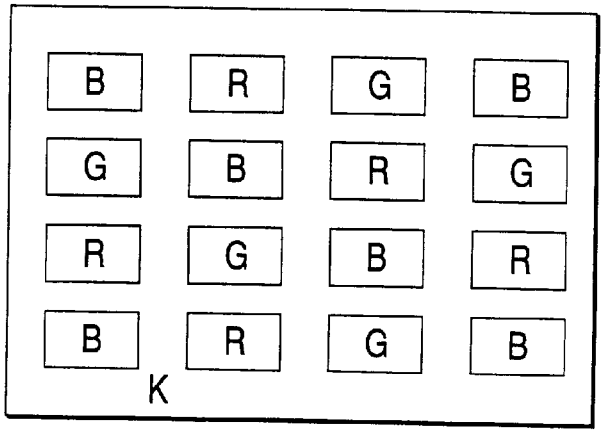
FIG. 2 is a scheme showing an embodiment of the RGB color filter according to the present invention.
Figure 3:
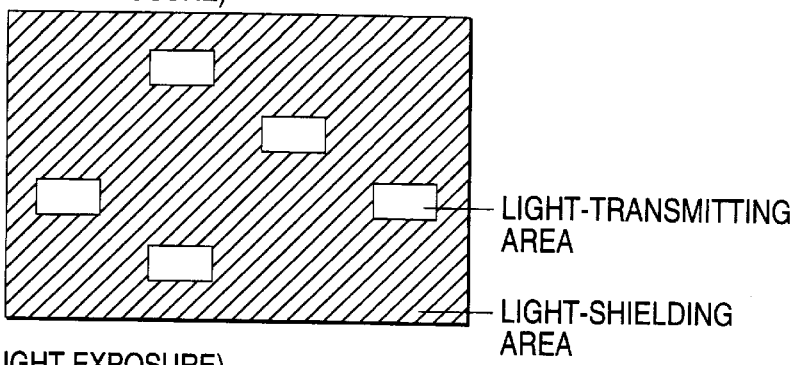
FIGS. 3(*a*) to 3(*d*) illustrate an embodiment of the pattern schemes of mask filters for use in exposing the photosensitive material of the present invention.
Figure 3:
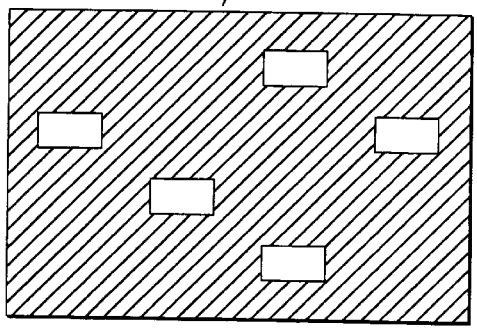
Figure 3:
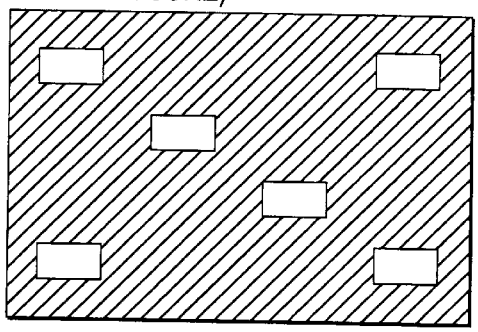
Figure 3:
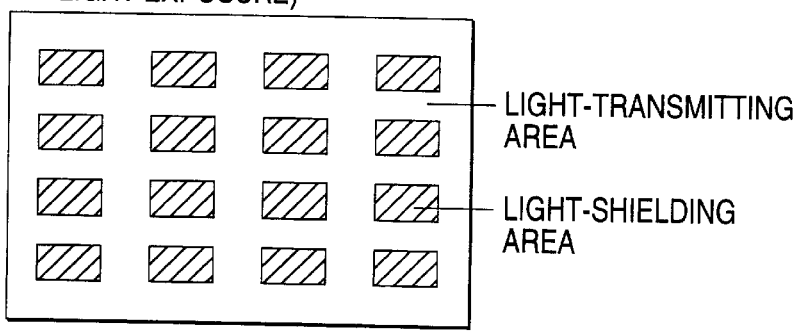

(a) An embodiment of the silver halide photosensitive material of the present invention comprises a substrate having provided thereon a blue-sensitive emulsion layer, a green-sensitive emulsion layer and a red-sensitive emulsion layer, prepared by using materials exhibiting the characteristic curves shown in FIG. 1, in which the blue-sensitive emulsion layer contains a cyan coupler and a magenta coupler (or a blue coupler), the green-sensitive emulsion layer contains a yellow coupler and a cyan coupler, and the red-sensitive emulsion layer contains the copolymer of the invention (red coupler) having a yellow coupler component and a magenta coupler component as its repeating units. The photosensitive material is separately exposed to red light, green light, blue light and white light using the respective four mask filters as shown in FIG. 3 each having such a pattern that gives exposures of point A and point B of FIG. 1 (these mask filters have light-transmitting areas corresponding to the red parts, green parts, blue parts and black parts of a color filter, respectively) and a color screen in conformity to the spectral sensitivity of the photosensitive material. The exposed photosensitive material is then subjected to color development, desilverizing and washing to provide a color filter comprising red pixels, green pixels, blue pixels and a black matrix as shown in FIG. 2.

(b) Another embodiment of the silver halide photosensitive material of the present invention has the same layer structure as in structure (I) except for additionally having an infrared-sensitive emulsion layer containing a coupler for color compensation designed to provide a substantially black color having a transmission density of 2.5 or higher (Equivalent neutral density (END) $\geqq$2.5) upon reaction of all the couplers present on the support. The infrared-sensitive emulsion layer, as the fourth silver halide emulsion layer, may be composed of two or more unit layers. An appropriate choice of the layer constitution for each unit layer and of the coupler to be incorporated makes it possible to omit the intermediate layer between the infrared-sensitive layer and other silver halide emulsion layers adjacent thereto. The coupler for color compensation may be the same as or different from the couplers for use in the red, green and blue-sensitive emulsion layers. The photosensitive material of this type is exposed to red light, green light, blue light and white light (including requisite infrared light) in the same manner as in the above embodiment (a) using four mask filters as shown in FIG. 3 and a color screen in conformity to the spectral sensitivity of the photosensitive material, and then developed, desilverized and washed to provide a color filter comprising red pixels, green pixels, blue pixels and a high-density black matrix as shown in FIG. 2.

In the above described embodiment (a) and (b), combination of color sensitivity is not limited to the above described combination of blue sensitivity, green sensitivity, red sensitivity and infrared sensitivity, and the combination may also include ultraviolet sensitivity or yellow sensitivity. The infrared sensitivity may have two or more sensitive wavelengths. The order of forming silver halide emulsion layers having different color sensitivity is not limited to the above-described one and can be selected arbitrarily. If desired, embodiments (a) and (b) may further have additional layers, such as a subbing layer, an intermediate layer, a bleachable yellow filter layer, a protective layer and an ultraviolet absorbing layer. In the present invention, embodiments (a) and (b) are preferably used for their excellent color reproducibility.

A micro color filter is obtained by subjecting the photosensitive material of the invention to color development process in a conventional manner as described in RD No. 17643, pp. 28–29 and RD No. 18716, p. 651, left to right columns.

For example, processing comprising color development, desilverizing and washing is performed. In the desilverizing step, a bleach-fix processing step using a blix solution can be carried out instead of a bleach-processing step using a bleaching solution and a fixation-processing step using a fixing solution, or all of a bleach-processing step, a fixation-processing step and a bleach-fix processing step may be performed in an arbitrary order. A stabilizing step may be carried out instead of a washing step, or it may be carried out after the washing step. Further, a monobath processing step, in which color development, bleach and fixation operations are performed in a monobath using a developing, bleaching and fixing processing solution, can be carried out. In combination with these processing steps, a prehardening step, a neutralizing step therefor, a stop-fix processing step, an afterhardening step, an adjustment step, an intensification step and so on may be carried out. In these processing processes, the so-called activator processing step may be carried out instead of a color-development processing step.

As described in JP-A-7-159610, the color development processing and the desilverizing processing may be carried out using an autopositive emulsion of internal latent image type in combination with a nucleating agent and fogging with light.

Where the substrate of the photosensitive material is flexible, a developing apparatus used for ordinary photographic processing can be used. Where the substrate is a hard one (e.g., a glass plate), a developing apparatus for dry plates or the apparatus described in JP-A-7-56015 can be used.

Exposure is carried out by a face exposure system through a mask or a scanning exposure system. The scanning exposure system applicable to the present invention includes a point scanning system by line (slit) scanning or laser exposure. Examples of light sources include a tungsten lamp, a halogen lamp, a fluorescent tube (three-wavelength fluorescent lamp), a mercury lamp, a laser beam and a light-emitting diode. A halogen lamp, a fluorescent lamp and a laser beam are preferred.

In another exposure system applicable to the photosensitive material of the invention, the photosensitive material is exposed three times using a liquid crystal display panel, into which the color filter prepared by the invention is to be incorporated, in combination with a color screen as disclosed in JP-A-8-201616.

The color filter produced according to the method of the present invention can have a protective layer (or an overcoat layer) comprising a heat-resistant, water-resistant, and electrically highly resistive resin as the outermost layer. Examples of such a resin are described in U.S. Pat. Nos. 4,698,295 and 4,668,601, EP-A-179636, EP-A-556810, JP-A-3-163416, JP-A-3-188153, JP-A-5-78443, JP-A-1-276101, JP-A-60-216307 and JP-A-63-218771.

The color filter according to the method of the present invention can also be provided with a transparent electrode of indium-tin oxide (ITO) by vacuum coating, for example, vacuum evaporation or sputtering. An orientation film comprising a polyimide resin, etc. can further be provided thereon. Further, the transparent substrate of the color filter may be provided with a polarizing plate and a phase contrast film on the side opposite the emulsion side.

A color liquid crystal display (LCD) using the color filter of the present invention is described below.

Figure 4:
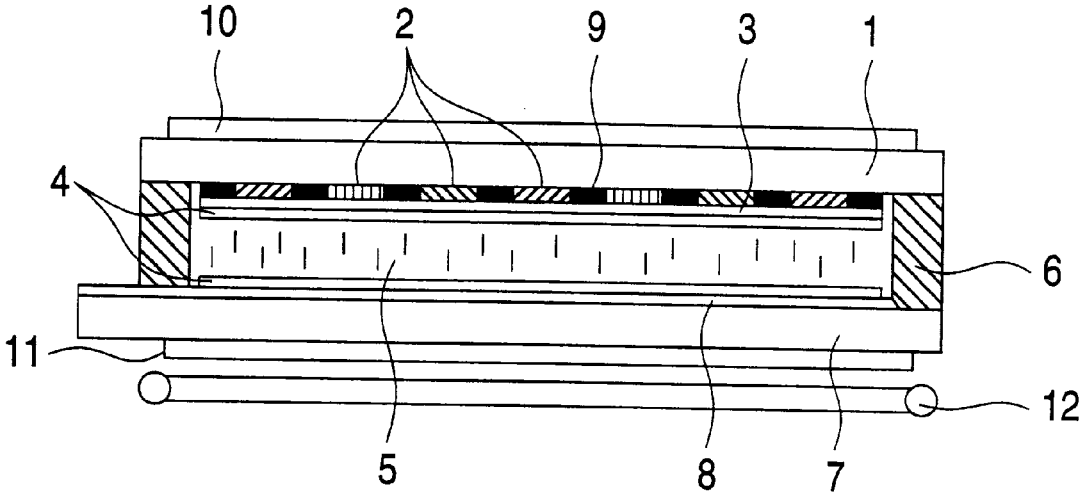
FIG. 4 is a vertical sectional view of an embodiment of color liquid crystal displays (LCD) using the present color filter.

A vertical sectional view of an embodiment of the liquid crystal display is shown in FIG. 4. The color filter 2 produced in accordance with an embodiment of the present invention is provided on a glass substrate 1. On the surface of the color filter 2, a protective layer is formed by coating with the above described resin, though it is not shown in the figure. Onto the protective layer, a transparent electrode 3 (e.g., an ITO electrode) is attached using a vacuum filming apparatus. The transparent electrode 3 is made in the form of monolithic electrode covering the entire surface in the case of an active matrix driven LCD using a tree-terminal switching array, such as TFT, while it is generally made in the form of stripe electrode in the cases of a simple matrix driven LCD and an active matrix drive LCD using a two-terminal switching array, such as MIM. On this transparent electrode 3 is arranged an orientation layer 4 composed of polyimide or the like for orientating liquid crystal molecules.

The glass substrates 1 is assembled with another glass substrate 7 having similarly provided thereon a transparent electrode 8 (e.g., ITO electrode) and an orientation layer 4 in this order, into a liquid crystal cell with spaces (not shown) and sealing material 6 therebetween. The transparent electrode 8 is a pixel electrode connected with TFT elements in the case of an active matrix driven LCD using a three-terminal switching array, such as TFT, while it is generally a stripe electrode in the case of a simple matrix driven LCD using a STN liquid crystal. In the latter case, the stripes of transparent electrodes 3 and 8 is arranged so as to cross at right angles.

A black matrix 9 is generally formed between every two of R, G and B pixels for improving contrast and color purity. The black matrix 9 can be formed simultaneously with R, G and B pixels as in the present invention. Alternatively, a Cr or carbon film can be formed as the black matrix separately from the formation of those pixels. Further, the glass substrates 1 and 7 are provided with polarizing plates 1 and 11, respectively, on their respective back sides. In addition, it is possible to insert a phase compensation film (which is not shown in the figure) between each pair of a glass substrate and a polarizing plate.

Since LCD using a color filter has a small light transmission, back light 12 having conformity with the color filter with respect to color reproduction is generally placed.

The glass substrate as a light-transmitting substrate may be displaced with a plastic film substrate having a gas barrier layer or a hard coating layer.

Details of color LCD and production methods thereof are described, e.g., in Shoich Matsumoto and Ichiyoshi Kadota, *Ekisho no Kiso to Oyo* (Fundamentals and Application of Liquid Crystals), Kogyo Chosakai (1991), *Flatpanel Display* 1994, compiled by Nikkei Micro Device and published by Nikkei BP (1993), and JP-A-1-114820.

The present invention will be described in more detail with reference to the following Examples, but the invention should not be construed as being limited thereto.

COMPARATIVE EXAMPLE 1

A photosensitive silver halide emulsion (Emulsion (I)) was prepared in the following manner:

To a well-agitated aqueous gelatin solution having the composition shown in Table 7, a solution (Soln. (I)) shown in Table 8 was added for 1 minutes. After a lapse of 20 seconds from the start of the addition of Soln. (I), another solution (Soln. (II)) shown in Table 8 was added for 40 seconds. Two minutes after, other solutions (Soln. (III) and Soln. (IV)) shown in Table 8 were added simultaneously for 4 minutes.

TABLE 7

| Composition of aqueous gelatin solution | |
|---|---|
| $H_2O$ | 650 ml |
| Lime-processed gelatin | 20 g |
| NaCl | 3 g |
| Silver halide solvent (1) | 0.015 g |
| Temperature kept at | 40° C. |

TABLE 8

| | Soln. (I) | Soln. (II) | Soln. (III) | Soln. (IV) |
|---|---|---|---|---|
| $AgNO_3$ | 20 g | | 80 g | |
| NaCl | | 4.91 g | | 29.5 g |
| Total volume* | 120 ml | 85.7 ml | 480 ml | 514 ml |

*Water was added to make each total volume shown above.

Silver halide solvent (1)

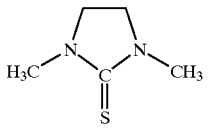

The reaction mixture obtained was washed and desalted (with a precipitant (a) under pH 4.0) in a conventional manner, and then admixed with 22 g of delimed gelatin, followed by dispersion. After adjusting the pH to 6.0, 4 ml of a 10% aqueous solution of sodium chloride and further 70 mg of antiseptics (1) were added to the resulting dispersion. Thus, a silver chloride emulsion having a grain size of 0.15 μm (Emulsion (I)) was obtained. The yield of Emulsion (I) was 630 g.

Precipitant (a)

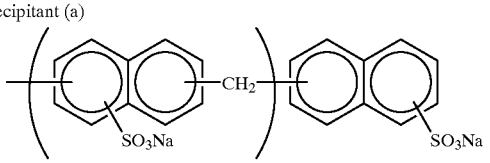

n = 3~4

Antiseptics (1)

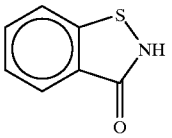

Another silver halide emulsion (Emulsion (II)) was prepared in the following manner:

A silver chlorobromide emulsion having a chloride content of 70 mol % was prepared in the same manner as the silver halide emulsion (I), except that the compositions of an aqueous gelatin solution, Soln. (II) and Soln. (IV) were changed to those shown in Tables 9 and 10. The grain size of the thus prepared Emulsion (II) was 0.18 μm.

TABLE 9

| Composition of aqueous gelatin solution | |
|---|---|
| $H_2O$ | 650 ml |
| Lime-processed gelatin | 20 g |
| NaCl | 3 g |
| KBr | 0.3 g |
| Silver halide solvent (1) | 0.015 g |
| Temperature kept at | 40° C. |

TABLE 10

| | Soln. (I) | Soln. (II) | Soln. (III) | Soln. (IV) |
|---|---|---|---|---|
| $AgNO_3$ | 20 g | | 80 g | |
| NaCl | | 3.46 g | | 20.7 g |
| KSr | | 3.0 g | | 18.0 g |
| Total volume* | 120 ml | 85.7 ml | 480 ml | 514 ml |

*Water was added to make each total volume shown above.

A 100 μm-thick polyethylene terephthalate support coated with a dispersion of carbon black in polyvinyl chloride as a backing layer was coated with a gelatin subbing layer. Further thereon, ten constituent layers having the compositions described below (from the first layer to the tenth layer) were provided using a simultaneous multilayer coating method to prepare a color photosensitive material (Sample No. 1A). Ingredients comprising each composition and their respective coating amounts (expressed in g/m$^2$ unit) are described below. Coating amounts of the silver halide are shown in terms of silver.

| | |
|---|---|
| 1st layer (peeling layer): | |
| Hydroxyethyl cellulose (HEC-SP500; Daisel Ltd.) | 0.35 |
| Polyvinyl alcohol modified by alkyl groups at the molecular ends (average polymerization degree: 300) | 0.08 |
| Antistatic agent (Cpd-1) | 0.03 |
| 2nd layer (neighboring layer): | |
| Gelatin | 0.50 |
| 3rd layer (blue-sensitive layer): | |
| Emulsion (II) spectrally sensitized with blue sensitizing dyes (ExS-1 and ExS-2) | 0.33 |
| Gelatin | 0.99 |
| Cyan coupler (ExC-2) | 0.54 |
| Magenta coupler (ExM-1) | 0.02 |
| High boiling solvent (Solv-1) | 0.28 |
| 4th layer (interlayer): | |
| Gelatin | 0.38 |
| Color mixing inhibitor (Cpd-7) | 0.09 |
| Color mixing inhibitor (Cpd-10) | 0.02 |
| High boiling solvent (Solv-1) | 0.03 |
| High boiling solvent (Solv-3) | 0.01 |
| Ultraviolet absorbent (Cpd-5) | 0.02 |
| Ultraviolet absorbent (Cpd-4) | 0.02 |
| Ultraviolet absorbent (Cpd-3) | 0.01 |
| Ultraviolet absorbent (Cpd-6) | 0.02 |
| Polymer (Cpd-8) | 0.04 |
| 5th layer (infrared sensitive layer): | |
| Emulsion (II) spectrally sensitized with an infrared sensitizing dye (ExS-6) | 0.39 |
| Stabilizer (Cpd-9) | 0.008 |
| Gelatin | 1.29 |
| Cyan coupler (ExC-2) | 0.10 |
| Magenta coupler (ExM-2) | 0.28 |
| Yellow coupler (ExY-1) | 0.41 |
| Discoloration inhibitor (Cpd-2) | 0.05 |
| High boiling solvent (Solv-1) | 0.19 |
| High boiling solvent (Solv-2) | 0.04 |
| High boiling solvent (Solv-4) | 0.08 |
| Polymer (Cpd-11) | 0.03 |
| 6th layer (interlayer): | |
| Gelatin | 0.38 |
| Color mixing inhibitor (Cpd-7) | 0.09 |
| Color mixing inhibitor (Cpd-10) | 0.02 |
| High boiling solvent (Solv-1) | 0.03 |
| High boiling solvent (Solv-3) | 0.01 |
| Ultraviolet absorbent (Cpd-5) | 0.02 |
| Ultraviolet absorbent (Cpd-4) | 0.02 |
| Ultraviolet absorbent (Cpd-3) | 0.01 |
| Ultraviolet absorbent (Cpd-6) | 0.02 |
| Polymer (Cpd-8) | 0.04 |
| Yellow dye (YF-1) | 0.17 |
| 7th layer (green-sensitive layer): | |
| Emulsion (I) spectrally sensitized with a green sensitizing dye (ExS-3) | 0.43 |
| Gelatin | 1.09 |
| Cyan coupler (ExC-1) | 0.33 |
| Yellow coupler (ExY-2) | 0.42 |
| High boiling solvent (Solv-1) | 0.08 |
| High boiling solvent (Solv-2) | 0.11 |
| Polymer (Cpd-11) | 0.03 |

-continued

| | |
|---|---|
| 8th layer (interlayer): | |
| Gelatin | 0.38 |
| Color mixing inhibitor (Cpd-7) | 0.09 |
| Color mixing inhibitor (Cpd-10) | 0.02 |
| High boiling solvent (Solv-1) | 0.03 |
| High boiling solvent (Solv-3) | 0.01 |
| Ultraviolet absorbent (Cpd-5) | 0.02 |
| Ultraviolet absorbent (Cpd-4) | 0.02 |
| Ultraviolet absorbent (Cpd-3) | 0.01 |
| Ultraviolet absorbent (Cpd-6) | 0.02 |
| Polymer (Cpd-8) | 0.04 |
| Irradiation preventing dye (Dye-1) | 0.005 |
| Irradiation preventing dye (Dye-2) | 0.02 |
| 9th layer (red-sensitive layer): | |
| Emulsion (I) spectrally sensitized with red sensitizing dyes (ExS-4 and ExS-5) | 0.35 |
| Gelatin | 1.14 |
| Yellow coupler (ExY-1) | 0.60 |
| Magenta coupler (ExM-2) | 0.25 |
| Discoloration inhibitor (Cpd-2) | 0.06 |
| Polymer (Cpd-11) | 0.03 |

-continued

| | |
|---|---|
| High boiling solvent (Solv-1) | 0.12 |
| High boiling solvent (Solv-2) | 0.03 |
| High boiling solvent (Solv-4) | 0.11 |
| 10th layer (protective layer): | |
| Gelatin | 0.70 |
| Antihalation dye (fine-grain dispersion) | 0.15 |
| Carboxymethyl cellulose | 0.05 |
| Polymer (Cpd-12) | 0.14 |
| Surfactant (Cpd-13) | 0.03 |
| Hardener (H-1) | 0.12 |

In each layer were further used sodium dodecylbenzenesulfonate as an assistant for emulsified dispersion, ethyl acetate as an auxiliary solvent, surfactant (Cpd-14) as a coating aid, and potassium polystyrenesulfonate as a thickener.

The structural formulae of the compounds used are shown below:

ExS-1

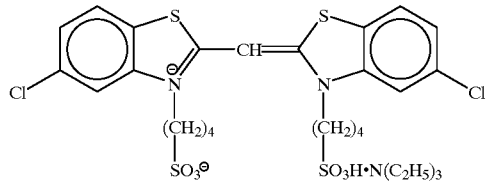

ExS-2

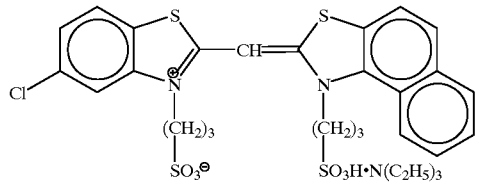

ExS-3

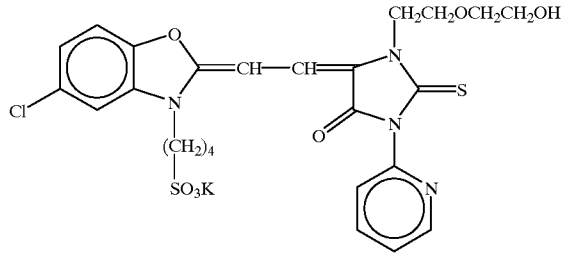

ExS-4

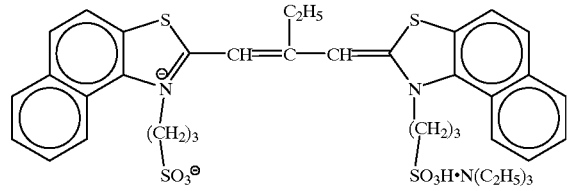

-continued
ExS-5
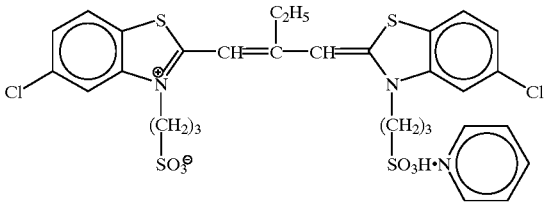
ExS-6
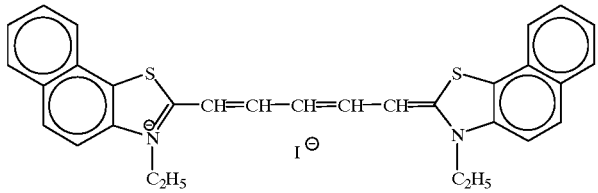
ExC-1
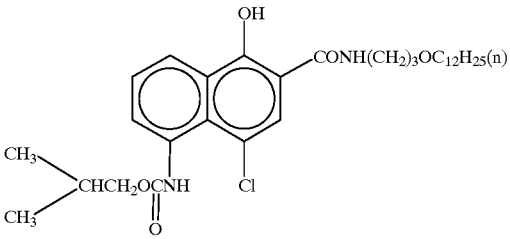
ExM-1
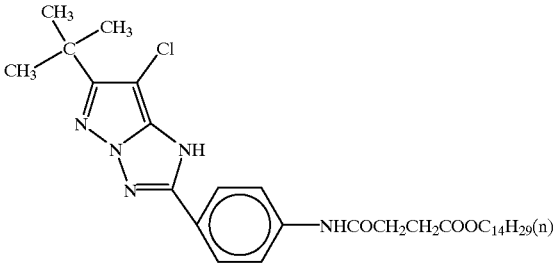
ExY-1
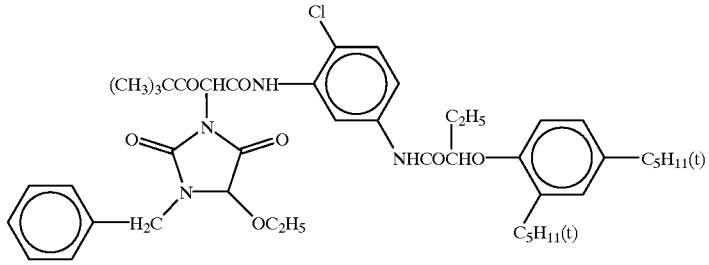
ExC-2
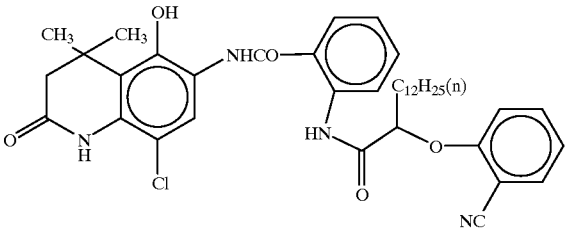

-continued
ExM-2
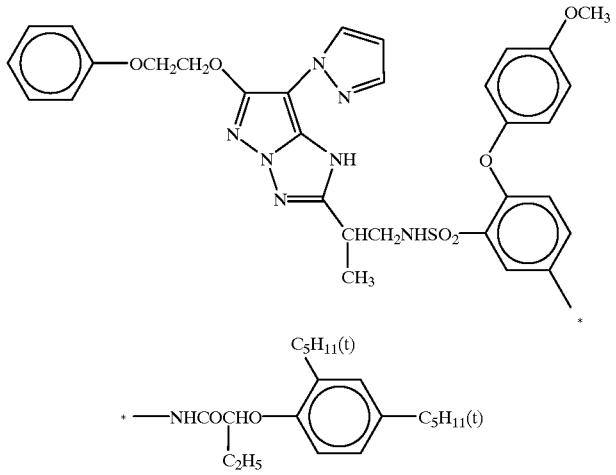
ExY-2
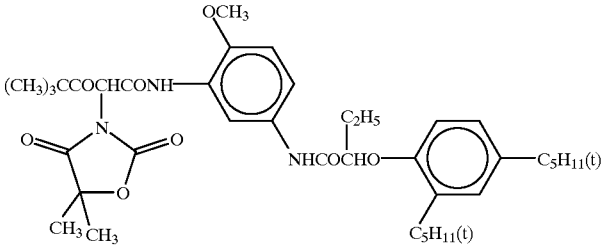
Cpd-1
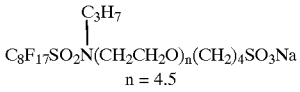
Cpd-2
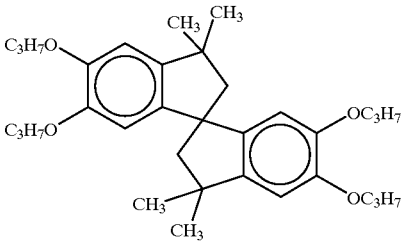
Cpd-3
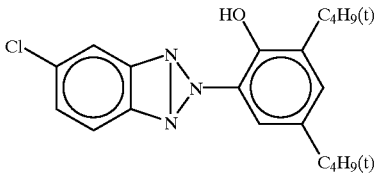
Cpd-4
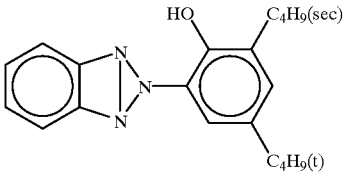

-continued
Cpd-5
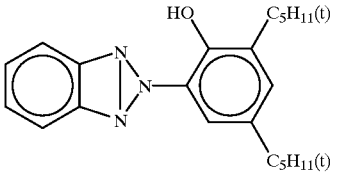
Cpd-6
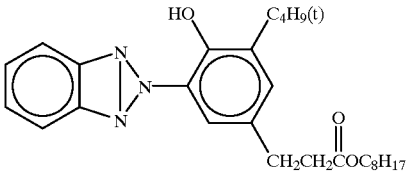
Cpd-7
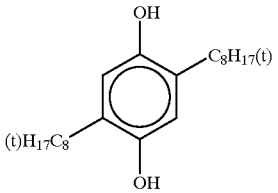
Cpd-8
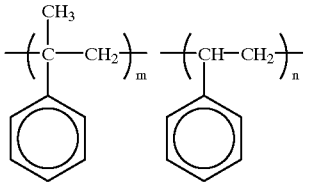
m/n = 9/1
Cpd-9
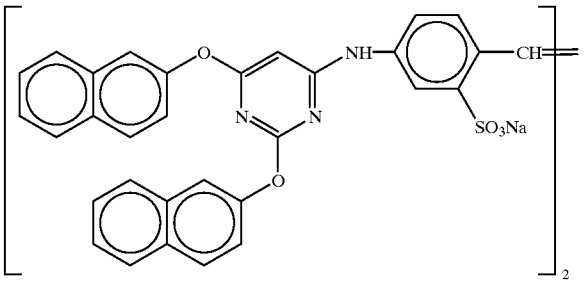
Cpd-10
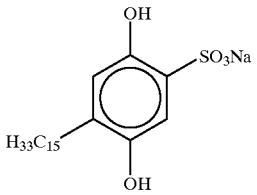
Cpd-11
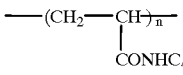
n = 100–1000
Cpd-12
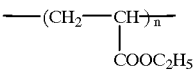
n = 100–1000

-continued
Cpd-13
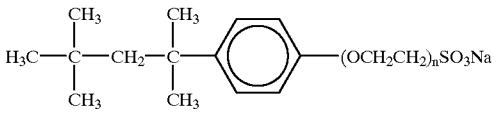
n = 3
Cpd-14
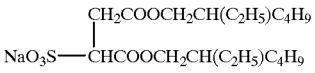
Solv-1
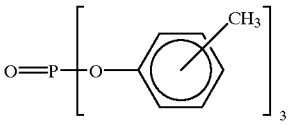
Solv-2
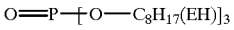
Solv-3
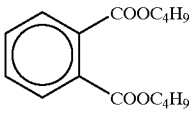
Solv-4
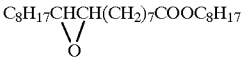
YF-1
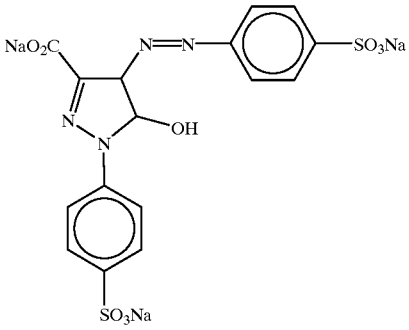
Dye-1
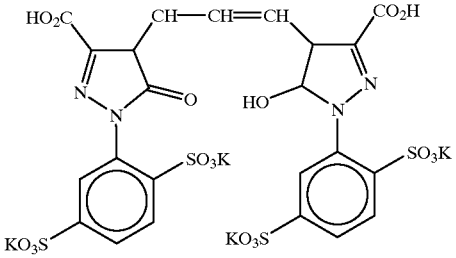
Dye-2
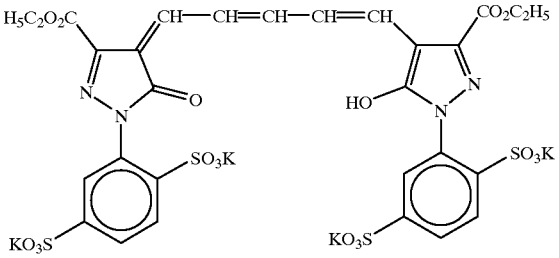
H-1
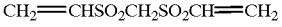

-continued

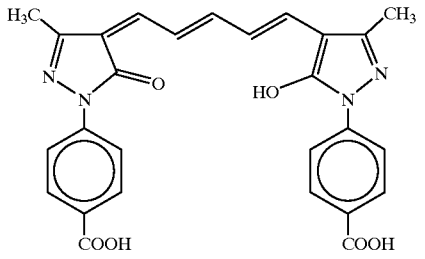

Antihalation dye

COMPARATIVE EXAMPLE 2

A color photosensitive material (Sample No. 1B) was prepared in the same manner as in comparative Example 1, except that each of the coating amounts of high boiling solvents in the 9th layer (red-sensitive layer) and each of those in the 5th layer (infrared-sensitive layer) were doubled.

COMPARATIVE EXAMPLE 3

A color photosensitive material (Sample No. 1C) was prepared in the same manner as in comparative Example 1, except that the yellow coupler in the 9th layer (red-sensitive layer) and the 5th layer (infrared layer) and the magenta coupler therein were replaced with the same molar amounts of the following yellow coupler (Comparative Coupler (A)) and magenta coupler (comparative Coupler (B)), respectively.

Comparative Coupler (A)

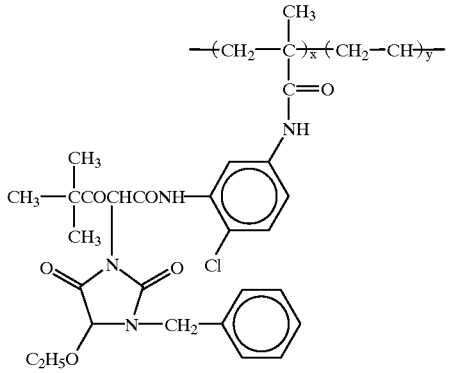

x/y = 50/50 wt%:

Comparative Coupler (B)

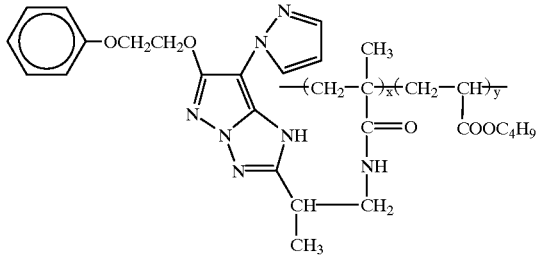

x/y = 50/50 wt%:

EXAMPLE 1

Color photosensitive materials (Sample Nos. 2A to 2X) were prepared in the same manner as the color photosensitive material of Sample No. 1A, except that the inventive couplers (P-1), (P-2), (P-4), (P-5), (P-7), (P-9), (P-11), (P-12), (P-14), (P-17), (P-18), (P-20), (P-23), (P-25), (P-26), (P-29), (P-36), (P-37), (P-38), (P-42), (P-58), (P-74), (P-87), and (P-99) were, respectively, used in their respective 9th layers in place of the combination of the yellow coupler (ExY-1) and the magenta coupler (ExM-2) used in the 9th layer of Sample No. 1A, and that only Solv-1 was used as the high boiling solvent in each 9th layer in the same weight as the inventive coupler used.

EXAMPLE 2

Color photosensitive materials (Sample Nos. 3A to 3H) were prepared in the same manner as the color photosensitive material of Sample No. 1A, except that the inventive couplers (P-1), (P-2), (P-3), (P-24), (P-27), (P-39), (P-34) and (P-54) were, respectively, used in their respective 5th layers in place of the combination of the yellow coupler (ExY-1) and the magenta coupler (ExM-2) used in the 5th layer of Sample No. 1A, and that only Solv-1 was used as the high boiling solvent in each 5th layer in the same weight as the inventive coupler used.

EXAMPLE 3

A 1.1 mm-thick, transparent, alkali-free glass (20 cm×30 cm in size) was used as light-transmitting substrate, and the surface thereof was coated with a composition prepared by mixing gelatin and colloidal silica (average particle size: 7–9 mμ) in the ratio of 1 to 3 by weight and adding thereto saponin as a surfactant. The dry thickness of the coating layer thus formed was 0.2 μm.

The protective layer of the above prepared color photosensitive material and the coating layer of the transparent glass substrate were brought into intimate contact and passed through a laminator set to give the contact surface a temperature of about 130° C. at a speed of 0.45 m/min. After cooling to about room temperature, the support of the photosensitive material was stripped off the emulsion surface together with the peeling layer to provide the transparent glass substrate having thereon the 2nd to 10th emulsion layers. As a result, these emulsion layers were uniformly adhered and free from blank areas.

Each of the thus prepared substrates having the emulsion layers was subjected to four successive exposure operations from the emulsion side using tungsten light and the mask filter as shown in FIG. 3 on which a color screen conforming to the spectral sensitivity of the photosensitive material was superposed. The thus exposed substrate was then subjected to photographic processing in accordance with the following processing steps. Thus, a color filter with three colors, B, G and R, and black color developed by a single photographic processing was obtained.

| Processing Step | Temperature | Time |
|---|---|---|
| Hardening | 36° C. | 3 min. |
| Washing (1) | 35° C. | 1 min. |
| Color development | 38° C. | 80 sec. |
| Bleach-fix | 38° C. | 90 sec. |
| Washing (2) | 35° C. | 40 sec. |
| Washing (3) | 35° C. | 40 sec. |
| Drying | 60° C. | 2 min. |

The composition of each processing solution is shown below.

| | |
|---|---|
| Hardening solution: | |
| Sodium sulfate (anhydrous) | 160.0 g |
| Sodium carbonate (anhydrous) | 4.6 g |
| Glyoxal-propylene glycol adduct (55%) | 20.0 ml |
| Water to make | 1 l |
| pH (25° C.) = 9.5 | |
| Color developer: | |
| Water | 800 ml |
| Diethylene glycol | 12.0 ml |
| Benzyl alcohol | 13.5 ml |
| Ethylenediaminetetraacetic acid | 3.0 g |
| Disodium 4,5-dihydroxybenzene-1,3-disulfonate | 0.5 g |
| Triethanolamine | 12.0 g |
| Potassium chloride | 6.5 g |
| Potassium bromide | 0.03 g |
| Potassium carbonate | 27.0 g |
| Sodium sulfite | 0.1 g |
| Disodium N,N-bis(sulfonatoethyl)hydroxylamine | 5.0 g |
| Sodium triisopropylnaphthalene(β)sulfonate | 0.1 g |
| N-ethyl-N-(β-methanesulfonamidoethyl)-3-methyl-4-aminoaniline sesquisulfate monohydrate | 5.0 g |
| Water to make | 1 l |
| pH (25° C.) = 10.0 | |
| Bleach-fix bath: | |
| Water | 600 ml |
| Ammonium thiosulfate (750 g/l) | 93 ml |
| Ammonium sulfite | 40.0 g |
| Ammonium bromide | 25.0 g |
| Ammonium ethylenediaminetetraacetatoferrate(III) | 55.0 g |
| Ethylenediaminetetraacetic acid | 5.0 g |
| Nitric acid (67%) | 30.0 g |
| Water to make | 1 l |
| pH (25° C.) = 5.8 | |

Washing water:

Deionized water having electric conductivity of not more than 5 μS.

Every color filter thus obtained had R, G and B colors with excellent spectral transmission with no turbidity, and black stripes of high density.

Each color filter was placed in an oven, and therein it was heated at 180° C. for 2 hours. After the heating, red pixels and black stripes of each color filter were observed under an optical microscope, and the extent of blur was judged. Further, light fastness of each color filter was examined with a Xenon fade-o-meter (85,000 lux, for 10 days), and evaluated by the percentages of yellow and magenta dyes remaining after the irradiation with Xenon light. With respect to the color filters using the photosensitive materials prepared in Example 1, the results obtained are shown in Table 11; while, with respect to the color filters using the photosensitive materials prepared in Example 2, the results obtained are shown in Table 12.

In these tables, the mark "+" denotes a high extent of blur, the mark "±" denotes a blur in an allowable level, and the mark "−" denotes no blur. Additionally, the light fastness value was obtained as the percentage of each residual dye with the optical density at $\lambda_{max}$ after the irradiation with Xenon light.

TABLE 11

| Sensitive Material No. | Coupler in 9th layer | Extent of pixel blur | Light Fastness yellow dye | Light Fastness magenta dye | Note |
|---|---|---|---|---|---|
| 1A | ExY-1 ExM-2 | ± | 66 | 57 | comparison |
| 1B | ExY-1 ExM-2 | + | 81 | 76 | comparison |
| 1C | Comparative coupler (A) Comparative coupler (B) | ± | 62 | 55 | comparison |
| 2A | P-1 | ± | 91 | 83 | invention |
| 2B | P-2 | ± | 90 | 85 | invention |
| 2C | P-4 | − | 93 | 85 | invention |
| 2D | P-5 | − | 93 | 90 | invention |
| 2E | P-7 | ± | 93 | 91 | invention |
| 2F | P-9 | − | 90 | 84 | invention |
| 2G | P-11 | ± | 92 | 87 | invention |
| 2H | P-12 | − | 93 | 82 | invention |
| 2I | P-14 | − | 95 | 89 | invention |
| 2J | P-17 | − | 93 | 90 | invention |
| 2K | P-18 | ± | 90 | 83 | invention |
| 2L | P-20 | − | 90 | 95 | invention |
| 2M | P-23 | ± | 92 | 83 | invention |
| 2N | P-25 | ± | 94 | 84 | invention |
| 2O | P-26 | ± | 95 | 89 | invention |
| 2P | P-29 | − | 93 | 97 | invention |
| 2Q | P-36 | − | 95 | 87 | invention |
| 2R | P-37 | ± | 87 | 83 | invention |
| 2S | P-38 | ± | 85 | 82 | invention |
| 2T | P-42 | ± | 86 | 84 | invention |
| 2U | P-58 | − | 88 | 81 | invention |
| 2V | P-74 | ± | 84 | 80 | invention |
| 2W | P-87 | ± | 85 | 80 | invention |
| 2X | P-99 | − | 81 | 77 | invention |

TABLE 12

| Sensitive Material No. | Coupler in 5th layer | Extent of black stripe blur | Light Fastness yellow dye | Light Fastness magenta dye | Note |
|---|---|---|---|---|---|
| 1A | ExC-2 ExY-1 ExM-2 | ± | 67 | 58 | comparison |
| 1B | ExC-2 ExY-1 ExM-2 | + | 84 | 75 | comparison |
| 1C | ExC-2 coupler (A) Comparative coupler (B) | ± | 68 | 56 | comparison |
| 3A | P-1 | ± | 95 | 86 | invention |
| 3B | P-2 | ± | 93 | 88 | invention |
| 3C | P-3 | − | 95 | 85 | invention |
| 3D | P-24 | ± | 95 | 86 | invention |
| 3E | P-27 | ± | 94 | 86 | invention |
| 3F | P-30 | ± | 89 | 85 | invention |
| 3G | P-34 | − | 95 | 96 | invention |
| 3H | P-54 | ± | 90 | 78 | invention |

As can be seen from the results in Table 11, the color filters 2A to 2X produced using the inventive polymer coupler exhibited less blur due to heat in the red pixel part, and the yellow and magenta components thereof had improved light fastness. Also, the results shown in Table 12 demonstrate that the inventive couplers reduce a blur in the black stripe part and improve light fastness, i.e., the superiority of the inventive couplers.

In accordance with the present invention, thin color filter which exhibit less pixel blur and have a red or black color area having high fastness to heat and light can be obtained. Further, the color filter of the present invention requires no complicated production processes, has mass production suitability, hardly give rise to defects in the course of the production of a LCD panel, and has excellent light-transmitting properties.

While the invention has been described in detail and with reference to specific examples thereof, it will be apparent to one skilled in the art that various changes and modifications can be made therein without departing from the spirit and scope thereof.

What is claimed is:

1. A silver halide color photosensitive material comprising at least one red color-forming polymer coupler selected from the group consisting of:

copolymers derived from at least one yellow coupler monomer represented by the following formula (I) and at least one magenta coupler monomer represented by the following formula (II); and copolymers derived from at least one yellow coupler monomer represented by the following formula (I), at least one magenta coupler monomer represented by the following formula (II) and at least one non-color-forming monomer having an ethylene group and no capability to couple with an oxidized product of an aromatic primary amine developing agent:

(I)

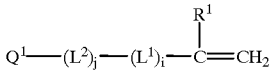

wherein $R^1$ represents a hydrogen atom, a chlorine atom, an alkyl group or an aryl group; $L^1$ represents —C(=O)N($R^2$)—, —C(=O)O—, —N($R^2$)C(=O)—, —OC(=O)—, or a group represented by the following formula (III), (IV) or (V); $R^2$ represents a hydrogen atom, an alkyl group, an aryl group or a heterocyclic group; $L^2$ represents a divalent linkage group connecting $L^1$ with $Q^1$; i represents 0 or 1; j represents 0 or 1; and $Q^1$ represents a yellow coupler residue capable of forming a yellow dye by coupling with an oxidized product of an aromatic primary amine developing agent;

(II)

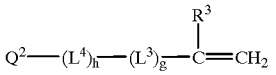

wherein $R^3$, $L^3$, $L^4$, g and h have the same meanings as $R^1$, $L^1$, $L^2$, i and j in the above formula (I), respectively; and $Q^2$ represents a magenta coupler residue capable of forming a magenta dye by coupling with an oxidized product of an aromatic primary amine developing agent;

(III)

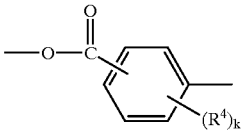

-continued (IV)

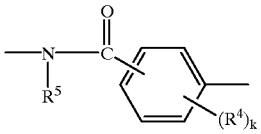

(V)

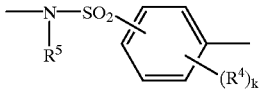

wherein $R^4$ represents a substituent group, $R^5$ has the same meaning as $R^2$ in the above formula (I), and k represents an integer of from 0 to 4.

2. The silver halide color photosensitive material of claim 1, which comprises a support having thereon at least three silver halide emulsion layers each having a different color sensitivity and containing couplers in such combination as to develop blue, green and red colors, respectively, by coupling with an oxidized product of an aromatic primary amine developing agent, wherein at least one of said emulsion layers contains said red color-forming polymer coupler.

3. The silver halide photosensitive material of claim 1, which comprises a support having thereon coated at least three silver halide emulsion layers each having a different color sensitivity, wherein at least one of said emulsion layers contains said red color-forming polymer coupler, and said material is used for color filter.

4. The silver halide photosensitive material of claim 3, wherein said silver halide emulsion layers contain couplers in such combination as to develop blue, green and red colors, respectively, by coupling with an oxidized product of an aromatic primary amine developing agent.

5. The silver halide photosensitive material of claim 3, further comprising at least one silver halide emulsion layer which is different in color sensitivity from the other emulsion layers and contains a coupler capable of making color compensation to produce a substantially black color having a transmission density of at least 2.5 when all the couplers on the support undergo coupling reaction.

6. The silver halide photosensitive material of claim 4, further comprising at least one silver halide emulsion layer which is different in color sensitivity from the other emulsion layers and contains a coupler capable of making color compensation to produce a substantially black color having a transmission density of at least 2.5 when all the couplers on the support undergo coupling reaction.

7. The silver halide color photosensitive material of claim 1, wherein the molar ratio of the yellow coupler monomer of formula (I) to the magenta coupler monomer of formula (II) is from 1:5 to 5:1.

* * * * *